US008763925B2

(12) United States Patent
Johnson

(10) Patent No.: US 8,763,925 B2
(45) Date of Patent: Jul. 1, 2014

(54) LAMINAR FLOW WATER JET WITH WAVE SEGMENTATION, ADDITIVE, AND CONTROLLER

(75) Inventor: Bruce Johnson, Lighthouse Pt., FL (US)

(73) Assignee: Pentair Water Pool and Spa, Inc., Sanford, NC (US)

( * ) Notice: Subject to any disclaimer, the term of this patent is extended or adjusted under 35 U.S.C. 154(b) by 504 days.

(21) Appl. No.: 12/940,010

(22) Filed: Nov. 4, 2010

(65) Prior Publication Data

US 2011/0073670 A1 Mar. 31, 2011

Related U.S. Application Data

(63) Continuation-in-part of application No. 11/280,392, filed on Nov. 17, 2005, now Pat. No. 7,845,579.

(51) Int. Cl.

| | |
|---|---|
| ***B05B 17/08*** | (2006.01) |
| ***B05B 1/34*** | (2006.01) |
| ***B05B 12/06*** | (2006.01) |
| ***F21S 8/00*** | (2006.01) |
| *F21Y 101/02* | (2006.01) |
| *F21S 10/02* | (2006.01) |
| *F21Y 103/00* | (2006.01) |
| *F21W 121/02* | (2006.01) |

(52) U.S. Cl.

CPC ..... *B05B 1/34* (2013.01); *F21Y 2101/02* (2013.01); *B05B 12/06* (2013.01); *F21S 10/02* (2013.01); *F21Y 2103/00* (2013.01); *F21S 8/00* (2013.01); *F21W 2121/02* (2013.01); *B05B 17/08* (2013.01)

USPC ..... 239/17; 239/18

(58) Field of Classification Search

CPC ..... B05B 17/08

USPC ..... 239/17, 18, 589, 589.1, 22, 23, 398, 239/407, 102.1

See application file for complete search history.

(56) References Cited

U.S. PATENT DOCUMENTS

| | | | |
|---|---|---|---|
| 2,261,948 | A | 11/1941 | Beach |
| 2,495,693 | A | 1/1950 | Byrd |

(Continued)

FOREIGN PATENT DOCUMENTS

| | | |
|---|---|---|
| DE | 3544368 | 6/1987 |
| DE | 3842298 | 6/1990 |

(Continued)

*Primary Examiner* — Davis Hwu

(74) *Attorney, Agent, or Firm* — Tangent Law Group, PLLC; Eric J. Weierstall, Esq.

(57) ABSTRACT

A laminar flow water jet system has a housing with a water channel, the housing creating a laminar flow in the water channel from the water flowing through the housing. A lighting element is provided with a controller. The laminar flow passes through at least one jetting element having a cup portion and a nozzle portion and jetting a laminar flow tube from the laminar flow passing through the water channel in the housing at the base portion. The laminar flow tube is ejected from the nozzle as a laminar flow jet having a smoothed tubular surface jacket and being lit by the lighting element. An additive source drips additive into the cup portion at a rate controlled by the controller, the additive being absorbed by capillary action by the laminar flow tube as it is passed through the nozzle to become the laminar flow jet. The absorption process drawing in air from the surrounding atmosphere and creating perturbations or bubbles within the laminar flow tube. In a further mode either an energetic pulse or an additive wave formed by increasing the volume of additive in the cup portion of the jetting element creates a wave perturbation or interruption throughout the laminar flow tube creating a variation in the laminar flow tube and the smoothed tubular surface jacket of the resulting laminar flow jet.

35 Claims, 11 Drawing Sheets

(56) References Cited

U.S. PATENT DOCUMENTS

| | | | |
|---|---|---|---|
| 3,473,565 | A | 10/1969 | Blenderman |
| 3,874,417 | A | 4/1975 | Clay |
| 3,924,808 | A | 12/1975 | Cooley, Jr. |
| 4,002,293 | A | 1/1977 | Simmons |
| 4,119,276 | A | 10/1978 | Nelson |
| 4,265,402 | A | 5/1981 | Tsai |
| 4,269,352 | A | 5/1981 | Przystawik |
| 4,548,240 | A | 10/1985 | Graham |
| 4,612,089 | A | 9/1986 | Hauptmann |
| 4,732,175 | A | 3/1988 | Pareja |
| 4,795,092 | A | 1/1989 | Fuller |
| 4,889,283 | A | 12/1989 | Fuller et al. |
| 4,946,164 | A | 8/1990 | Fuller et al. |
| 4,955,540 | A | 9/1990 | Fuller et al. |
| 5,078,320 | A | 1/1992 | Fuller et al. |
| 5,160,086 | A | 11/1992 | Kuykendal et al. |
| 5,201,343 | A | 4/1993 | Zimmermann et al. |
| 5,213,260 | A | 5/1993 | Tonkinson |
| 5,431,342 | A | 7/1995 | Saripalli et al. |
| 5,439,170 | A | 8/1995 | Dach |
| 5,785,089 | A | 7/1998 | Kuykendal et al. |
| 5,802,750 | A | 9/1998 | Fulmer |
| 5,820,022 | A | 10/1998 | Fukano et al. |
| 5,979,791 | A | 11/1999 | Kuykendal et al. |
| 6,053,423 | A | 4/2000 | Jacobsen et al. |
| 6,076,741 | A | 6/2000 | Dandrel et al. |
| 6,085,988 | A | 7/2000 | Marsh |
| 6,098,898 | A | 8/2000 | Storch |
| 6,276,612 | B1 | 8/2001 | Hall |
| 6,390,131 | B1 | 5/2002 | Kilgore |
| 6,427,927 | B1 | 8/2002 | Hall |
| 6,471,146 | B1 | 10/2002 | Kuykendal et al. |
| 6,484,953 | B2 | 11/2002 | Freier |
| 6,533,191 | B1 | 3/2003 | Berger et al. |
| 6,611,114 | B1 | 8/2003 | Yen |
| 6,641,056 | B2 | 11/2003 | Kuykendal et al. |
| 6,675,835 | B2 | 1/2004 | Gerner et al. |
| 6,717,383 | B1 | 4/2004 | Brunt et al. |
| 6,805,458 | B2 | 10/2004 | Schindler et al. |
| 6,947,837 | B2 | 9/2005 | Fukushima et al. |
| 7,264,176 | B2 | 9/2007 | Johnson |
| 8,042,748 | B2 | 10/2011 | Hagaman |
| 8,177,141 | B2 | 5/2012 | Hagaman |
| 2012/0037235 | A1 | 2/2012 | Hagaman |

FOREIGN PATENT DOCUMENTS

| | | |
|---|---|---|
| EP | 0565183 | 10/1993 |
| EP | 0595758 | 10/1993 |
| GB | 2054041 | 2/1981 |
| GB | 2244096 | 11/1990 |
| JP | 4341691 | 11/1992 |
| WO | 9413997 | 6/1994 |

LAMINAR FLOW WATER JET WITH WAVE SEGMENTATION, ADDITIVE, AND CONTROLLER

CROSS REFERENCE TO RELATED APPLICATIONS

This application is a continuation in part application of U.S. patent application Ser. No. 11/280,392 filed Nov. 17, 2005, now U.S. Pat. No. 7,845,579 which is incorporated herein by reference.

FIELD OF THE INVENTION

The invention relates to a water feature, specifically a controller and apparatus that imparts an energetic pulse wave or additive flood wave into the smooth jacket of water held by surface tension making up the outside of a laminar flow tube issuing from, for instance, a laminar flow water jet.

BACKGROUND OF THE INVENTION

It is often desired to utilize a fluid, such as water, as part of a display or attraction. Increasingly, the popularity of using water attractions as an integral part of domestic and commercial landscaping has moved architects and landscapers to push further and further into incorporating the decorative aspects of these water features into new buildings and building sites. These features are incorporated through swimming pools, spas, ponds, lakes and other water features and sources found in the typical property. Various types of fountains adorn public and private plazas, parks, advertisements, and amusement parks.

To this end, recent interest and developments have been made in producing smooth, laminar flows of water which give the appearance of a solid glass or clear plastic rod in various water attractions, for instance, the fountain presentation in the Bellagio Hotel in Las Vegas or the Dancing Frogs attraction at the EPCOT center of Disney World, as described in U.S. Pat. No. 5,078,320 to Fuller, et al. These attractions incorporate laminar flow water jets. These devices jet water like a fountain, but the water has a minimum of turbulence in it that is the water is predominantly laminar. The water tension of the flow issuing forth provides the tubular shape. The water tension forms an outer jacket around the laminar flow, creating a glass rod like laminar tube shape. This results in the smooth rod structure of the streams that are issued from the jets.

A first step in providing a laminar flow tube in a laminar flow jet is to produce a laminar water flow. These jet and fountain devices have used a wide variety of elements to instill laminarity into a water flow. Various attempts with a variety of elements have been made at inducing laminarity in a water stream. For example, U.S. Pat. No. 4,393,991 to Jeffras et al. discloses a sonic water jet nozzle which utilizes an elongated conical nozzle which includes fin-like members to reduce the turbulence of the water and to produce a laminar flow of water. U.S. Pat. No. 3,321,140 to Parkison et al. discloses an attachment for a faucet which utilizes a series of fins in a cylindrical nozzle for producing a laminar flow of water to reduce the splash on the bottom of a sink or tub. U.S. Pat. No. 3,730,440 to Parkison teaches a laminar flow spout which utilizes a plurality of independent nozzles arranged within a single spout which results in a plurality of streams having laminar flow characteristics. Systems like these and Applicant's co-pending U.S. patent application Ser. No. 11/280,392 and U.S. Pat. No. 7,264,176 for a Laminar Flow Water Jet with Pliant Member, all incorporated herein by reference, provide the laminar flow tubes that are so desirable in water attractions.

In addition to providing a laminar flow, it is often desirable to provide a controlled perturbation or interruption to the jet operation for the purposes of providing an artistic display. Again, referring back to the EPCOT display, the laminar flow jets function in a timed manner to provide an interesting display of water leaping from the frogs. There are various methods for producing columnarization or a controlled interruption of the laminar jet flow to produce discrete tubes. This is typically done by a mechanical diversion of the flow or a part of the flow for a controlled period of time.

Examples of this type of device can be seen in U.S. Pat. No. 4,889,283 which discloses a stream diverter that utilizes a diverter nozzle to split an output stream in a controlled fashion. This results in an interruption of the columnar length prior to its emergence from the device. Similarly, U.S. Pat. No. 5,802,750 discloses a spinning disk that interrupts the laminar flow after leaving the laminar flow water jet with a rotating wheel to simulate a jumping fish. However, these devices do not permit interruption of the laminarity without diversion of the flow jet or disruption of the column of the jet and, further, the devices do not provide a controllable energetic impulse or pulse to interrupt the jet without breaking the tube up in either the horizontal or vertical direction.

Similarly, along these lines, in U.S. Pat. No. 6,717,383 a programmable fountain controller is shown for varying the flow rate of a fountain pump in a predetermined manner so as to generate dynamically changing flow patterns. These include an audio input amplifier that sends signals to vary the pumps in time to the input. This design however fails to provide a pulse wave or any similar disruption of the flow in a laminar flow water jet.

Although there are devices available that add vibratory or oscillatory pulses into a water stream, for instance in U.S. Pat. No. 3,924,808 that shows a shower head vibrator is attached to the resilient coupling provided between the water outlet pipe and the shower head that produces an oscillatory pattern in the flow, these devices do not provide the controlled interruption necessary to maintain laminarity in a laminar flow water column. Instead, these devices oscillate a turbulent flow in a random fashion, typically to produce a massaging pulse or oscillating pressure variation for massaging a user. They fail to provide for a laminar flow column, much less the interruption of the laminar flow column in a controlled fashion with an energetic pulse.

To date, no method has been able to selectively interrupt the laminarity within or about the laminar jet tube of a laminar water jet without significant visible disruption or diversion of the laminar jet. Moreover, no method to date has allowed for a level of variation in the interruption of the laminarity in the laminar jet tube that would allow for both discrete jet tube lengths, i.e. columnarization, as well as multiple segments within a tube or columnarized flow, i.e. discrete segmentation. Further none of the existing devices allow for reflection enhancing perturbations from an additive drip in the jetted laminar flow tube. Furthermore, no system can produce columnarization or segmentation and allow for discrete multiple color effects in the tubes or in columns. An no system to date has provided an additive drip to enhance illumination within the laminar flow jet tube. Thus a need exists for a controller and a method of controlling a laminar water tube or jet that allows for selective interruption of the laminarity within the tube with or without the discrete columnarization of the tube, especially a method that utilizes an energetic pulse.

SUMMARY OF THE INVENTION

An object of the invention is to provide a laminar flow water jet controller with the ability to input a controlled additive flood pulse into the laminar flow water tube to discretely segment the tube, with or without discrete columnarization of the tube.

A further object of the invention is to provide a laminar flow water jet with light enhancement with heretofore unattainable illumination in long laminar segments with or without bright, starburst like interruptions within the laminar segment.

Yet another object of the invention is to provide enhanced illumination to the laminar flow tube through the dripping of an additive, the absorption of the additive admitting air bubbles or a turbulence to the laminar flow segment internally but maintaining the laminar flow segments surface structure.

A further object of the invention is to provide a laminar flow water jet that is more compact and cost effective and has a wider variety of display features than the heretofore known laminar flow water jets.

Yet another object of the invention is to provide a water jet with a pulsed laminar flow column through a controller element that inputs a pulsed amount of additive together with or exclusive of an energetic wave into the laminar flow to disrupt and columnarize the flow.

A still further object of the invention is to provide part of a laminar flow tube wherein a concentration of light is provided at a part of the laminar flow tube where a pulse wave or additive wave is transmitted into the tube.

Yet another object of the invention is to provide a starburst effect of light at a part of a laminar flow tube where a pulse wave is transmitted into the laminar flow tube and disrupts the surface tension of the tube, allowing for reflection and reflection of the light and a resulting concentration of the light at the part of the tube.

The invention includes a laminar flow water jet system the system having an at least one water input with water flowing therein. A housing with a water channel is provided, the housing creating a laminar flow in the water channel from the water flowing from the at least one water input and flowing through the housing. An at least one lighting element and a controller are also provided. In the system an at least one jetting element with a cup portion and a nozzle portion jets a laminar flow tube from the laminar flow that passes through the water channel in the housing, the laminar flow tube being ejected from the nozzle as a laminar flow jet having a smoothed tubular surface jacket and being lit by the at least one lighting element. An at least one additive source is provided and drips additive into the cup at a rate controlled by the controller, the additive being dripped into the cup portion of the jetting element at a rate to regulate the volume being absorbed by capillary action by the laminar flow tube as it is passed through the nozzle to become the laminar flow jet, the capillary uptake and absorption process drawing in air from the surrounding atmosphere and creating perturbations within the laminar flow tube. These perturbations being absorbed into the laminar flow tube and the resulting laminar flow jet without affecting the overall integrity of the smoothed tubular surface jacket of the laminar flow jet.

The controller can upon receiving a control input increase the flow of the additive to increase the volume of additive in the cup portion of the jetting element for a set period of time, the increased volume of additive surrounding the laminar flow tube, being taken up by the capillary action around the entirety of the laminar flow tube and creating a wave perturbation throughout the laminar flow tube as the increased volume of additive surrounding the laminar flow tube is absorbed via capillary uptake along with air from the surrounding environment by the laminar flow tube and jetted out of the nozzle portion of the jetting element, the wave perturbation creating a variation in the laminar flow tube and the smoothed tubular surface jacket of the resulting laminar flow jet.

The can further include an energetic pulse wave generating element, wherein the controller upon receiving a control input activates the wave generating element generating an energetic pulse that travels into the laminar flow tube and selectively interrupts the resulting smoothed tubular surface jacket of the laminar flow jet at a specific location on the laminar flow jet, thereby impairing the surface of and effecting the light passing within the laminar flow jet without disrupting the cohesion of the laminar flow jet.

The energetic pulse wave or the additive flow wave perturbation can provides a turbulent section within the laminar flow tube and these in turn can define segments in the laminar flow jet with perturbations in the smoothed tubular surface jacket surround the laminar flow jet without disrupting the cohesion of the laminar flow jet. The controller can be in communication with the at least one energetic pulse wave generating element, the controller sending a command to the at least one energetic pulse wave generating element to send the energetic pulse into the laminar flow tube. The energetic pulse wave or additive flow wave perturbation can also form discrete segments within the laminar flow tube and these segments can be maintained in the resulting laminar flow water jet without disrupting the cohesion of the laminar flow jet. The controller is in communication with the at least one additive source, the controller regulating the rate at which additive is admitted so as to coordinate the admission of the additive and resulting wave perturbation with an energetic pulse wave.

The laminar flow water jet system can further comprise an energetic pulse wave generating element generating an energetic pulse that travels into the laminar flow and selectively interrupts the laminar flow tube and the smoothness of the smoothed tubular surface jacket at a specific location in the resulting laminar flow jet. The controller can receive a control input from a timer. The controller can receive the control input from an audio or video input. The controller can receive the control input from a master controller. The controller can send signals to at least one of an at least one audio system, video system, and a timer. The controller can send signals to the at least one lighting element. The at least one lighting element can change a color input into the laminar flow water tube based on instructions from the controller. The at least one lighting element changes a color input into the discrete segments of the laminar flow water jet. The at least one lighting element can further comprise an at least one lighting tube and an at least one light source.

The laminar flow water jet system can further include a laminar flow jet disruptor in communication with the controller, wherein the laminar flow jet disruptor causes interruption of the laminar flow jet issuing from the jetting element causing discrete laminar flow jet columns to issue from the apparatus. The at least one lighting element can communicate with the controller and light the discrete laminar flow jet columns. The discrete laminar flow jet columns can be interrupted by the energetic pulse wave or additive wave perturbation such that the discrete columns are further distinctly segmented and the light source provides light to each of the distinct segments within the laminar flow jet columns. Each of the distinct segments can be lit with a different color. The controller receives a control input from an audio or video input. The controller can receive a control input from a master controller. The controller sends signals to at least one of an at least one audio system, video system, and a timer.

The apparatus of the invention includes an apparatus having an at least one water input, a housing with a water channel flowing through, an at least one jetting element jetting a laminar flow tube from a laminar flow passing through the water channel, and an at least one energetic pulse wave generating element generating an energetic pulse in a controlled fashion or an additive system that fills a cup around the nozzle to surround the laminar flow tube with additive, the additive being drawn into the flow along with minute perturbations that travel into the laminar flow and selectively interrupts the laminarity therein.

The apparatus further provides a controller in communication with the at least one energetic pulse wave generating element, the controller sending a command to the at least one energetic pulse wave generating element to send the energetic pulse into the laminar flow. The energetic pulse wave provides can provide a turbulent section within a continuous laminar flow tube. The energetic pulse wave can also provide a gap between discrete parts of the laminar flow water tube, creating discrete laminar flow columns.

The controller of the apparatus can receive an input from a timer. The controller can also receive an input from an audio or video input. The controller can also receive an input from a master controller. The controller can also send signals to at least one of an at least one audio system, video system, and a timer.

The apparatus may further provide an at least one lighting element. The at least one lighting element can light the laminar flow tube. The controller can send signals to the at least one lighting element. The at least one lighting element can change a color input into the laminar flow water tube based on instructions from the controller. The at least one lighting element can further include an at least one lighting tube and an at least one light source.

The apparatus can also provide a pliant member surrounding the water channel in the direction of flow of the water in the water channel, wherein the pliant member absorbs pump surges. A laminar flow disruptor can also be provided, the laminar flow disruptor being in communication with the controller, wherein the laminar flow disrupter causes interruption of the laminar flow tube issuing from the jet causing discrete laminar flow columns to issue. A light source can also be provided, with the light source communicating with the controller and lighting the discrete columns of laminar flow water. The discrete columns of laminar flow can also be interrupted by the energetic pulse wave such that a discrete column is discretely segmented and the light source provides light to each of the discrete segments. Each of the discrete segments can be lit by a different color.

The apparatus of the invention includes a laminar flow water jet, having an at least one water input admitting water into a housing, a housing conducting the water into a laminar flow water channel and ejecting the laminar flow water channel, a controller, and an at least one energetic pulse wave generating component, wherein the energetic pulse wave generating component sends an energetic pulse wave into the laminar flow water channel in a part of the laminar flow channel to interrupt the laminarity within the laminar flow at that part.

The water channel can be ejected as a laminar flow tube. The laminar flow water jet can also include an at least one lighting element. The at least one lighting element can further include a lighting tube and an at least one light source. The laminar flow tube can be colored by the lighting element.

The energetic pulse wave can provide a turbulent section within a continuous laminar flow tube. The energetic pulse wave can also provide a gap between discrete parts of the laminar flow water tube, creating discrete laminar flow columns.

The controller can receive an input from a timer. The controller can also receive an input from an audio or video input. The controller can also receive an input from a master controller. The controller can also send signals to at least one of an at least one audio system, video system, and a timer. The controller can further send signals to the at least one lighting element. The at least one lighting element can change a color input into the laminar flow water column based on instructions from the controller.

The laminar flow water jet can further provide a pliant member surrounding the water channel in the direction of flow of the water in the water channel, wherein the pliant member absorbs pump surges. A laminar flow disrupter can also be provided, the disruptor being in communication with the controller, wherein the laminar flow disruptor causes interruption of the laminar flow tube issuing from the housing, causing discrete laminar flow columns to issue there from. A light source can be provided, the light source communicating with the controller and lighting the discrete columns of laminar flow water. The discrete columns of laminar flow can be interrupted by the energetic pulse wave such that a discrete column is discretely segmented and the light source provides light to each of the discrete segments. Each of the discrete segments can be lit by a different color.

The apparatus of the invention also includes a water feature. The water feature can include water jets, water flows, waterfalls, and similar elements using a laminar flow. The water feature having a housing with a water channel, an at least one water input providing water to the water channel, an at least one laminar flow member to impart laminarity into the water in the water channel; an at least one issuing element, issuing a laminar flow from the housing; and an at least one energetic pulse wave generating member generating and transmitting an at least one energetic pulse wave into the laminar flow of the water channel in a controlled fashion to interrupt the laminarity in part of the laminar flow.

The method of the invention includes a method of providing multiple colors within a laminar flow of water, including the steps of providing a laminar flow of water, lighting the laminar flow of water, inputting an energetic pulse wave or an additive wave or flow to disrupt the laminarity of the water flow at a specific part and provide discreet segmentation of the laminar flow of water without significantly disrupting the laminar flow jet, and changing the light color between different discrete segments in the laminar flow jet. The method of providing multiple colors within a laminar flow further provides the method step of jetting the laminar flow of water into a laminar flow tube. The method of providing multiple colors can also include the method step of columnarizing the laminar flow tube, wherein discrete columns are created in laminar flow tube with the discrete segmentation therein, and the columns being points where the laminar flow tube is broken apart into a variety of segments.

The method of the invention also includes a method of operating a laminar flow water jet including the method steps of generating a laminar flow within a water channel in conjunction with a pump, monitoring a control input with a controller, sending an energetic pulse wave into the laminar flow upon a command from the controller, jetting the laminar water flow to form a laminar jet tube with controlled interruptions imparted by the energetic pulse wave to segment the laminar jet tube, and ejecting the laminar flow column.

The method of sending an energetic impulse upon a command can further include sending a command based on a change in or signal from a control input. The control input can be an at least one of a timer, an audio input and a video input. The method step of sending an energetic impulse can be accomplished via an energetic wave-generating component. The method step of sending an energetic impulse energetic pulse can occur after jetting the water tube. The method can further comprise the method step of changing color for each segment ejected.

The method of the invention includes also a method of producing segmentation in a laminar flow tube comprising the method steps of providing a laminar flow tube, generating an pulse wave, and transmitting the pulse wave or additive wave into the laminar flow tube, wherein the surface tension in the tube is interrupted at a horizon of transmission. The method can further include the method step of lighting the laminar tube, wherein the step of lighting is coordinated with the step of transmitting the pulse wave into the laminar flow tube. The step of lighting can further include providing multiple wavelengths of light for each segment created by a pulse wave in the laminar flow tube.

Moreover, the above objects and advantages of the invention are illustrative, and not exhaustive, of those which can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

Embodiments of the invention are explained in greater detail by way of the drawings, where the same reference numerals refer to the same features.

DETAILED DESCRIPTION OF THE INVENTION

Figure 1:
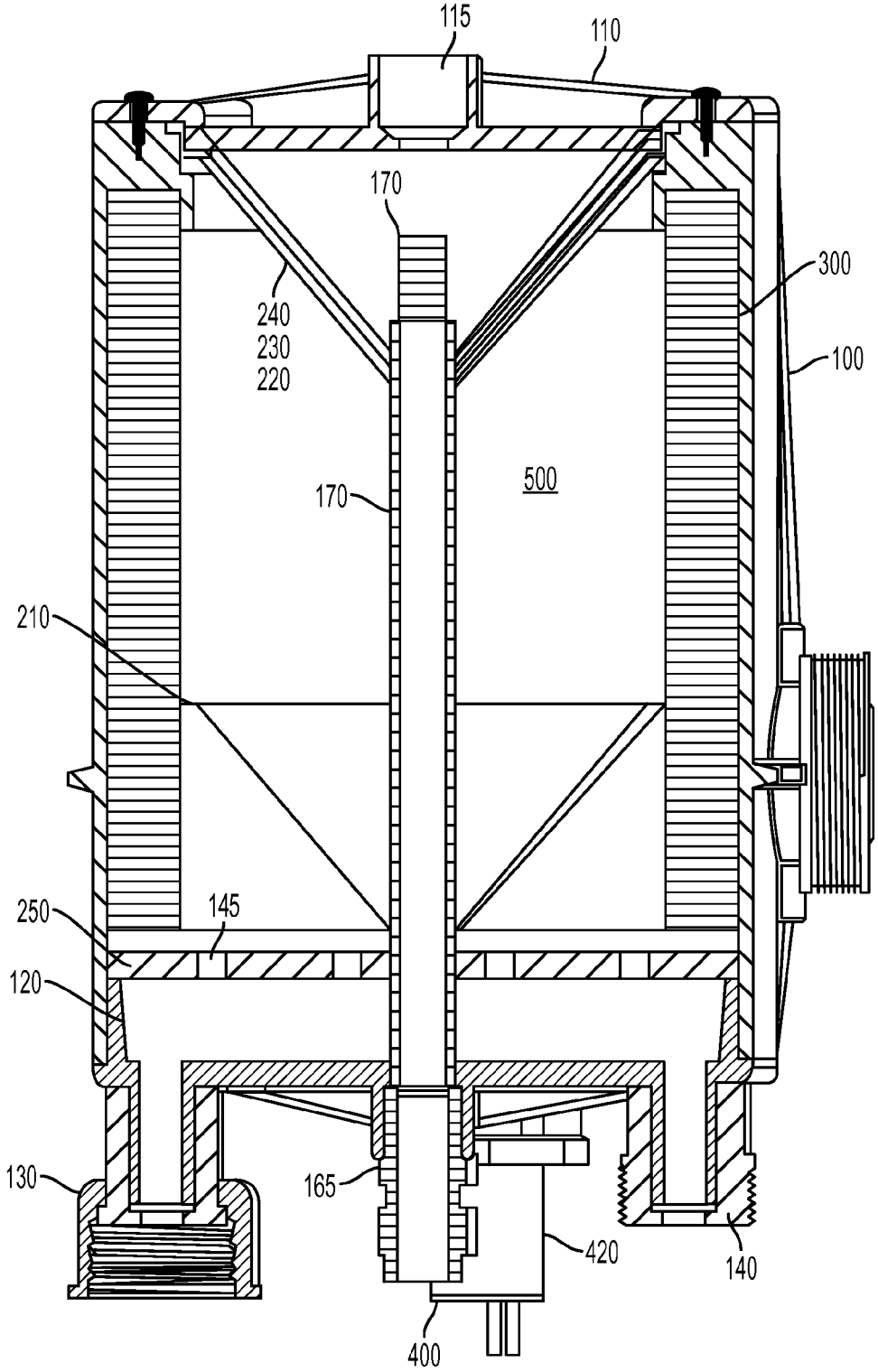
FIG. 1 shows a cross-sectional view of an exemplary embodiment of the instant invention.

FIG. 1 shows a cross sectional view of the exemplary embodiment of the instant invention. The exemplary embodiment of FIG. 1A comprises a housing 100, a housing top 110 with an at least one jet element 115 extending there through, and a housing base 120. Flowing into the housing base 120 is an at least one water input, in this instance a first water input 130 and a second water input 140. Within the housing 100 a laminar water flow channel 500 resides. Additionally, a lighting orifice 165 is provided and passes through the base plate to couple to a lighting tube 170. The lighting tube 170 extends into the laminar water flow channel 500 and through the housing 100 toward the at least one jet element 115. The lighting tube 170 is provided to apply lighting effects to the exiting water. The tube may utilize any appropriate lighting system, including but not limited to, conventional incandescent, halogen, fiber optic, LED, nano scale lighting devices or similar lighting systems. Furthermore, although the exemplary embodiment utilizes a light tube, any appropriate manner of focusing the lighting system may be used to illuminate the exiting water jet.

In the exemplary embodiment shown, internal to the housing 100 and the laminar water flow channel 500 flows from the multiple inputs 130, 140, into an at least one baffle member 250 with a plurality of orifices 145 situated therein. Alternatively, the baffle member may be omitted from further exemplary embodiments. Above the multiple inputs 130, 140 shown, an at least one filter member, in this case a series of filter members, is provided.

A first filter member 210 is provided in the laminar water flow channel 500 of the exemplary embodiment show in approximately the middle of the housing chamber. Variations in the placement, the positioning, the spacing, the shape, the size, and the number of members or screens can be provided alone or in conjunction with variations in sizes, density, construction, shapes, mesh size, screen gauge, and other variables to suit the particular design constraints of a further exemplary embodiment without departing from the spirit of the invention. Surrounding the interior of the housing 100 is an at least one elastomeric or pliant member 300 through which the laminar water flow channel 500 passes.

In the exemplary embodiment shown, in addition to the first filter 210 the at least one filter member includes a further series of three filter members 220, 230, 240 above the first filter member 210, which helps provide additional laminarity to the water as it flows towards the at least one jet element 115. The additional filter members 220, 230, 240 are also shown as conical in shape. However, it should be understood by one of ordinary skill in the art that the variations in geometry, number, and placement/spacing of the filter members are within the spirit of the invention. Additionally, the at least one pliant member 300 can include an at least one pliant member mounted on or within an at least one of the at least one filter members. Further, it is readily evident to those of ordinary skill in the art that the controller 400 and the at least one pulse generating component 420 can be included in existing laminar devices and the exemplary embodiment is only one example of such a system.

The control package 400 is provided on the exterior of the housing 100, as shown in FIG. 1. It would be understood by one of ordinary skill in the art that the controller 400 could be located on any laminar flow device or on any appropriate location as the type of controller 400 may dictate. As depicted in the exemplary embodiment of FIG. 1 the control package 400 is provided as a controller 400 and an at least one pulse wave generating component, in this instance a solenoid 420. The controller 400 can also add an additive flow device as shown in FIGS. 2A-2D or omit the at least one energetic pulse wave generating component and instead use an additive flow mechanism as discussed below with respect to FIGS. 2A-2D.

The controller 400 provides a variable timed input to produce a controlled pressure variance or pulse wave and controls the additive admission within the laminar flow jet 10 as herein described below.

With respect to the energetic pulse, the energetic pulse can be accomplished in any number of ways, in the exemplary embodiment shown, the solenoid 420 "thumps" or strikes the side(s) of the housing 100 to produce the pressure wave within the laminar water flow channel 500. Additional methods of providing the controlled variable pulse wave within the water flow may be utilized, for example the components of the package can be made to include digital electronic, analog electronic, electromechanical, or mechanical components suitable for producing a controlled input, such as a mechanical striking mechanism with a motor and clocks, an inline water wheel that driven by the incoming water flow, a return drip system that strikes the laminar water flow channel, sonic devices, electromechanical striking devices and similar components that can provide a metered pulse wave to interrupt the laminar jet as an pulse wave generator.

The control package 400 can comprise additional components. The controller may alternatively be comprised of all solid state components, all electrical components, all mechanical components, or any suitable combination therein to provide the necessary controlled resonance or "thump" to create the pressure wave on or in the laminar water flow channel 500. The components may be located in contact with the housing 100 at any position in, on, within, or without the housing that would allow the energetic wave to enter the water channel. Similarly, the components may be located discreetly away from the water jet, for instance if the system is utilizing an ultrasonic device, such that contact with the housing 100 is not necessary to input the energetic wave.

In the exemplary embodiment shown, the solenoid 420 is controlled by the microprocessor 410 and may be timed to suit a desired application. For instance, the microprocessor 410 may time the impulse from the solenoid 420 to music. Additionally, the controller 400 may be controlled by a master controller 7000, as further shown and described in relation to FIG. 5, which controls additional features or accessories in a coordinated water display. The controller may also include a wireless controller or connection, also as shown further in relation to FIG. 5A.

Figure 2A:
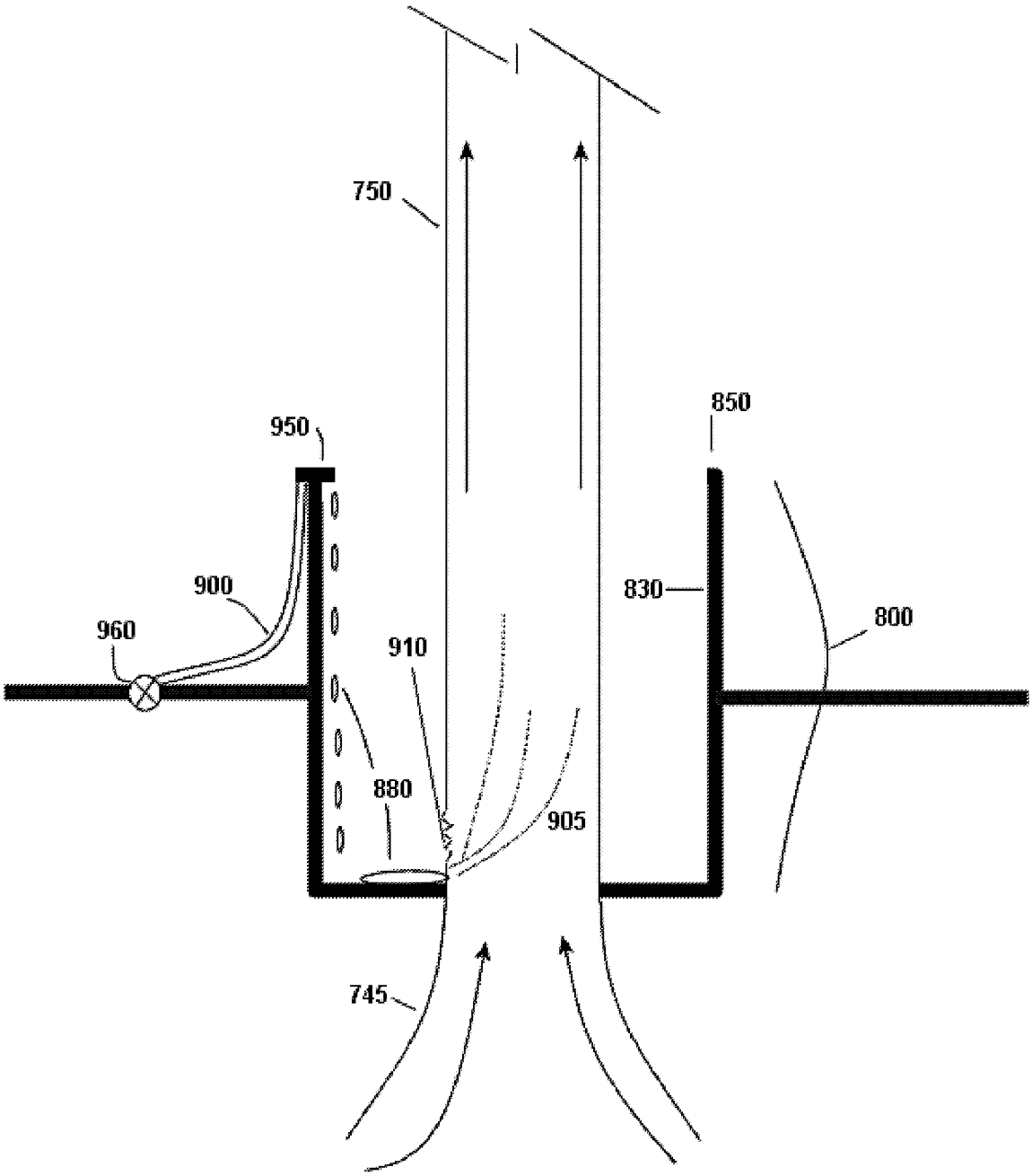
FIG. 2A shows a close up view of the exit of the laminar flow tube from the housing and the nozzle jetting the element with an additive drip.

FIG. 2A shows a close up view of the exit of the laminar flow tube from the housing and the nozzle jetting the element with an additive drip. In the exemplary embodiment of FIG. 2A, laminar flow jet 10 utilizes an at least one jet element 115 with a nozzle 800 to produce the laminar flow jet tube 750 and the associated smooth jacket of surface tension once the laminar flow column 745 is jetted as a laminar flow tube jets 750 out of the nozzle 800. In forming the laminar flow column 745, the laminar flow is passed through the nozzle 800. The nozzle has an initial point of exit 810 and a nozzle tip 850. The nozzle 800 forms a base or surround or "cup" portion 820 around the initial point of exit 810. The base portion 820 has a defined walls 830 extending therefrom to the nozzle tip 850. An additive source 950 can be added to the nozzle 800 such that it drips water into the base portion 820 of the nozzle 800, near the initial exit 810. An amount of additive 880 is allowed to accumulate in the base portion 820 and the additive 880 is picked up by the exiting laminar flow column 745. Alternatively, in a further embodiment of the invention, the additive 880 can be dripped by the additive source 950 directly onto the laminar flow tube 755. This would result in a similar uptake of the additive and resulting perturbations in the laminar flow jet 755 from admission of air as described herein. The amount of additive in the base or cup portion 820 effects the resulting laminar flow jet tube 755 in different ways depending on the amount of additive 880 admitted to the cup or base portion 820.

At a point of entry into the column 910, the additive 880 is picked up by the laminar flow column 745. This can be done for example by capillary action as the water passes the pooled additive. The wicking of the additive 880 creates a vacuum effect at the point of entry 910 into the column 745 drawing in air from the atmosphere and creating a minor disturbance or protuberance 905 in the jacket of the surface tension surrounding the laminar flow column being jetted. Again, as noted above, in a further embodiment the same effect can be achieved by directly dripping the additive 880 into the laminar flow tube or column 745, the drip being absorbed and a vacuum effect being created by the absorption due to the uptake of the additive and air from the surrounding environment. The uptake of the additive, for instance water, is completed so quickly that the laminar flow being jetted reaches the nozzle tip 850 and exits the nozzle tip 850 without any apparent disruption of the jacket of the surface tension surrounding the laminar jet tube 750 as it is formed beyond the nozzle base or "cup" 820 and passes out of the tip of the nozzle 850. In the exemplary embodiment of FIG. 2A, the laminar flow jacket is closed up at the exit of the nozzle tip 820.

The flow of the additive 880 and thereby the volume of additive available for uptake at the base portion 820 must be regulated and in this regulation the effect of the air being drawn in can be changed or completely stopped. The controller 400 can regulate the volume of additive 880. The controller 400 can be utilized with the energetic pulse wave input to enhance these effects or can independently control this volume flow rate. Alternatively, the device can function entirely independent of the energetic pulse wave input.

The variation of flow of the additive 880 varies the take up of the additive 880 by the laminar flow being passed from the nozzle base exit portion 810 and passed within the cup or base portion 820 of the laminar jet nozzle 800 and can be adjusted by the flow of the additive into the cup or base portion 820. This can be controlled through any method of filling the base or cup of the nozzle 820 or an additive drip member 950 within the nozzle 800. In the embodiment as show, an additive line 900 with a valve 960 rests at a side of the wall extending up from its base or cup 820 and drips water down the wall 830 of the nozzle to the cup into the bottom or the cup portion 820. The cup or base portion 820 in turn is filled and the additive 880, here water, is taken up by the exiting laminar flow stream 745 prior to exiting the jet nozzle 800. The valve can be manually adjusted or can be a controlled valve in communication with the controller 400. This results in perturbations 905 in the laminar flow stream without interfering with the jacket of surface tension around the resulting laminar flow jet or jet tube 750 upon exit from the nozzle tip 850.

In an exemplary embodiment this is dripped into the cup or base portion 820 via a valve controlled 960 admission line 900 pouring water into the nozzle base or cup 820. Other examples of and locations for a supply line include locating a channel within the housing that shunts some water through the channel at the bottom or at an upper edge of the wall or a similar flow element external to the body or housing that is situated to admit the water in this way. Other variations or combinations may be employed without departing from the spirit of the invention.

The controller 400 noted above could be located on any laminar flow device on any appropriate location. In addition to or exclusive to the control of the pulse wave generating components. The controller 400 through a control input determines the flow of additive into the base portion or cup 820. This flow can be adjusted to provide the desired perturbations 905 and provide the smooth jacket of surface tension around the jetted laminar flow tube jet 750. The controller can also provide additional volume changes in the additive 880 to adjust the effect as further described in relation to FIG. 2B and other variations to provide a variety of effects.

The flow at which the additive 880 is dripped in controls the resulting effect within the laminar flow column 745 and the laminar flow tube jet 755. If a very slow flow rate is dripped in a slow take up causes a very small but persistent air space behind the point of take-up 910. This in turn creates a perturbation 905 within the laminar flow, for instance small air bubbles, and the additive 880 is simply absorbed into the laminar flow tube 745 as the laminar flow tube is jetted to become the laminar flow jet 750. This perturbation 905 acts as a refractory element and increases the intensity of light shown through the resulting jetted laminar flow jet tube 750.

Figure 2B:
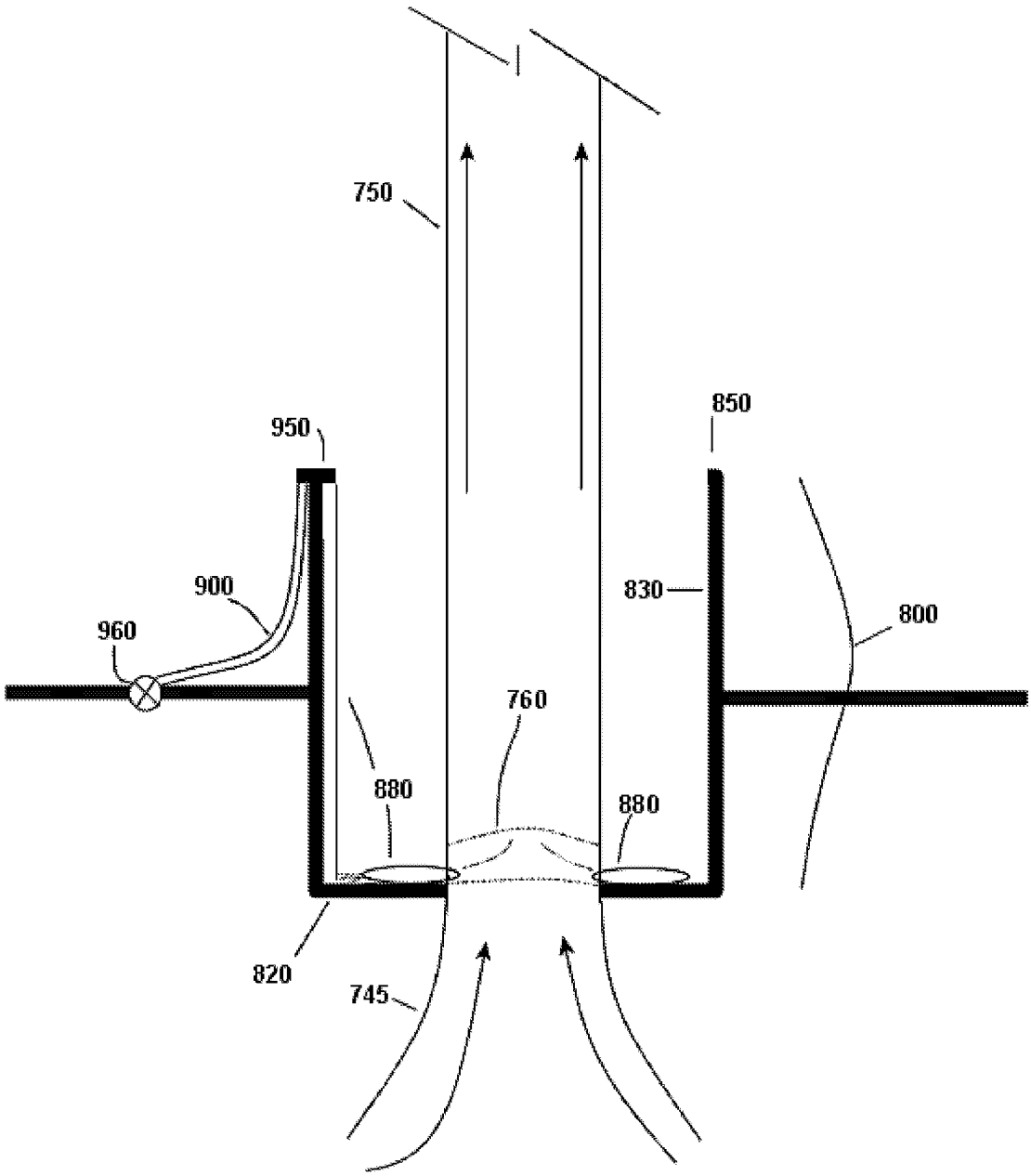
FIG. 2B shows a close up view of the exit of the laminar flow tube from the housing and the nozzle jetting the element with an additive flood.
Figure 3A:
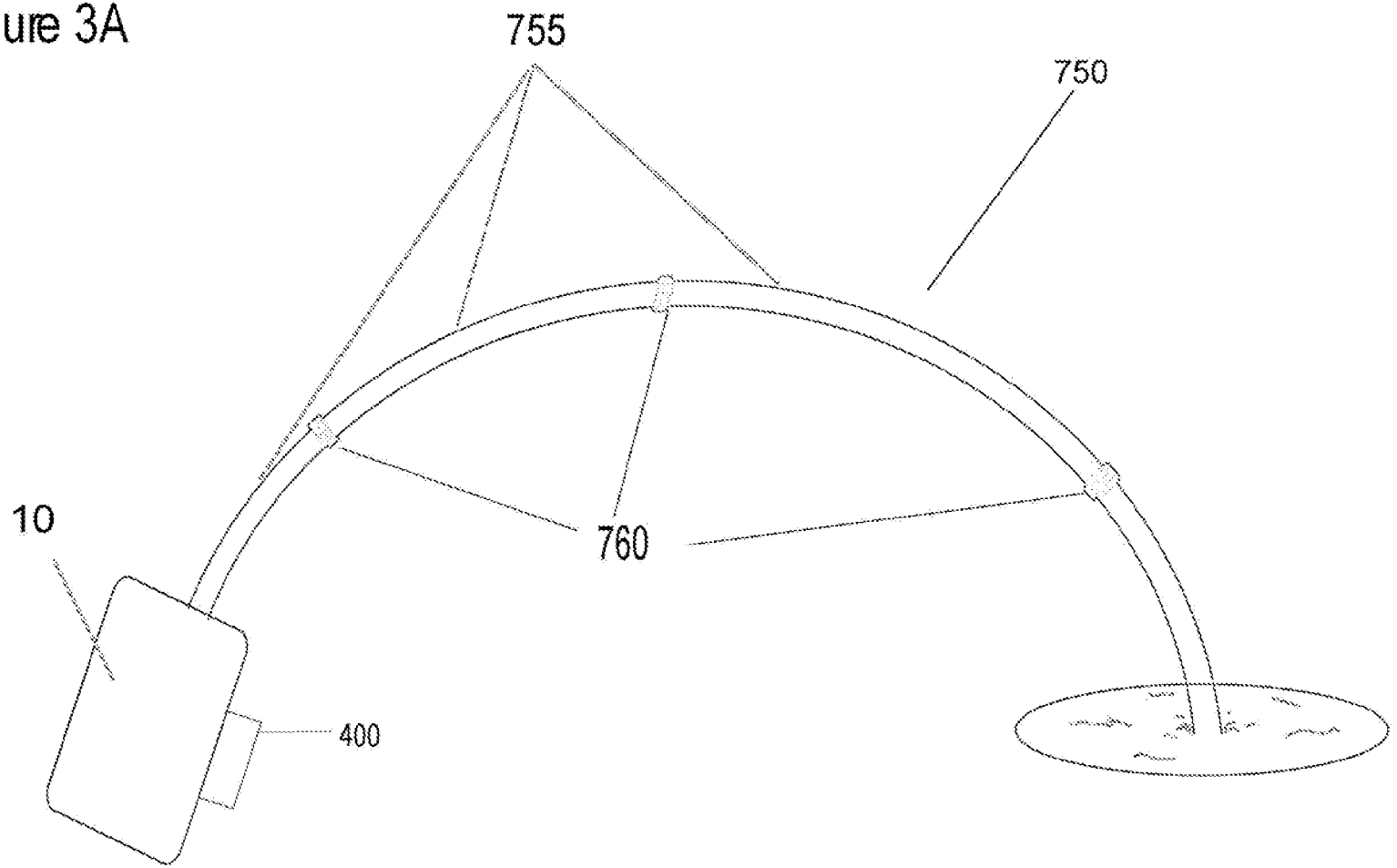
FIG. 3A shows an exemplary embodiment of the instant invention in operation with a segmented tubular flow.
Figure 3B:
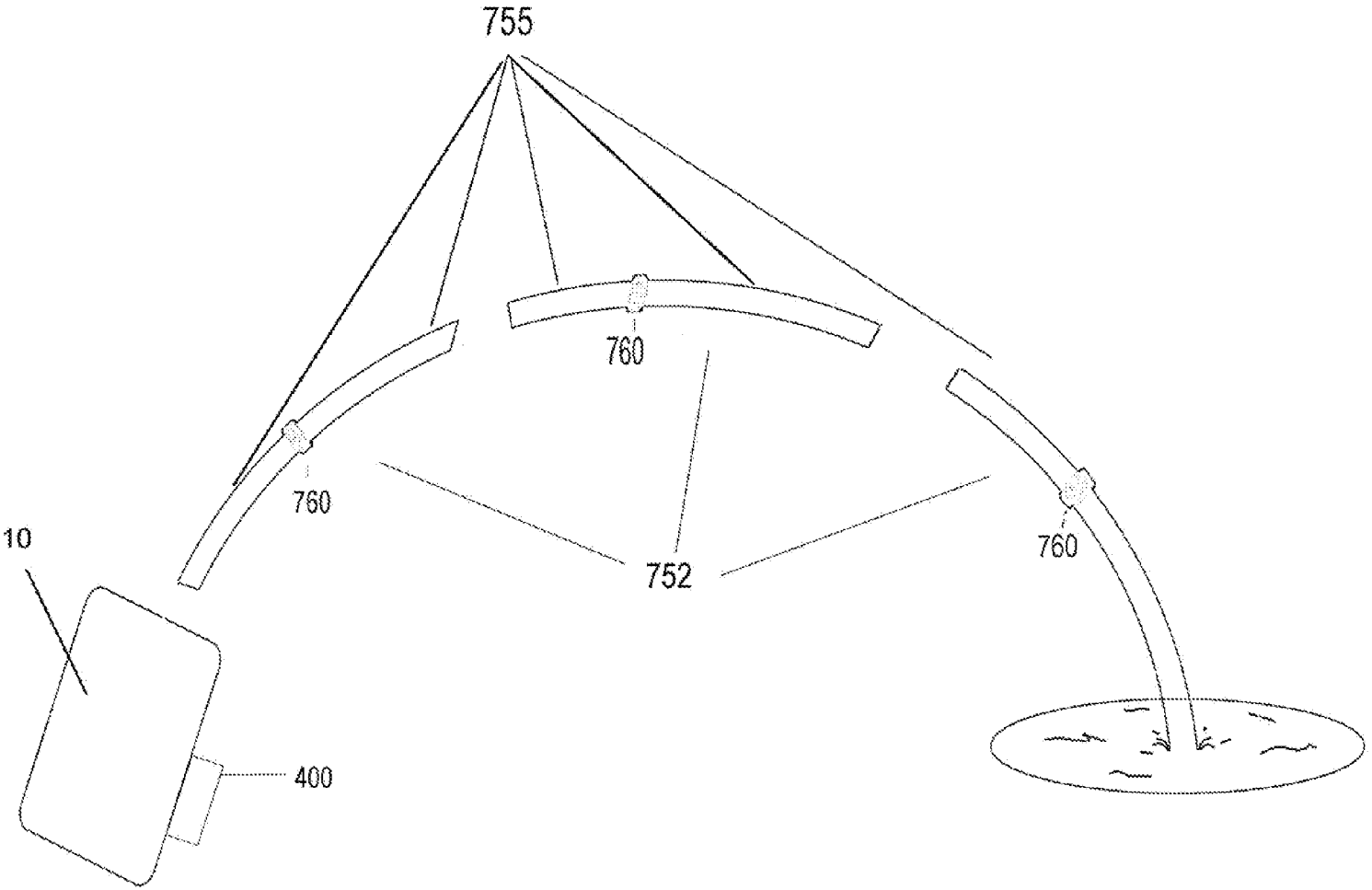
FIG. 3B shows an exemplary embodiment of the instant invention in operation with a segmented columnarized flow.

FIG. 2B shows a close up view of the exit of the laminar flow tube from the housing and the nozzle jetting the element with an additive flood. By adjusting the flow rate higher, a "flood" effect or wave of additive 880 can be created whereby the additive 880 is taken up through the entirety of the laminar flow tube 745 and creates a non-transmissive barrier at the wave 760 within the laminar flow jet tube 750. This can be coordinated with an energetic pulse to further help perturb the laminar flow columns surface tension as previously described herein. This effectively creates a "hole" in trasmissivity for the light traveling in the laminar flow column, a barrier beyond which the light cannot travel and provides for segmentation of the lighting effects. Similarly, in an alternative embodiment, a very large volume "drop" of the additive 880 can be dripped into the laminar flow column or tube 745 to achieve the effect of blocking transmissivity around the entirety of the laminar flow tube 745 through the uptake of the higher volume "drop" of additive 880, equivalent to the flood wave as described below. The absorption of the larger volume of dripped additive 880 results in a larger uptake of air into and around the laminar flow tube 745. As noted this segmentation can, in all embodiments, be coupled with the energetic pulse segmentation and, likewise, can be combined with the energetic pulse columnarization, as shown in FIGS. 3A and 3B.

Figure 2C:
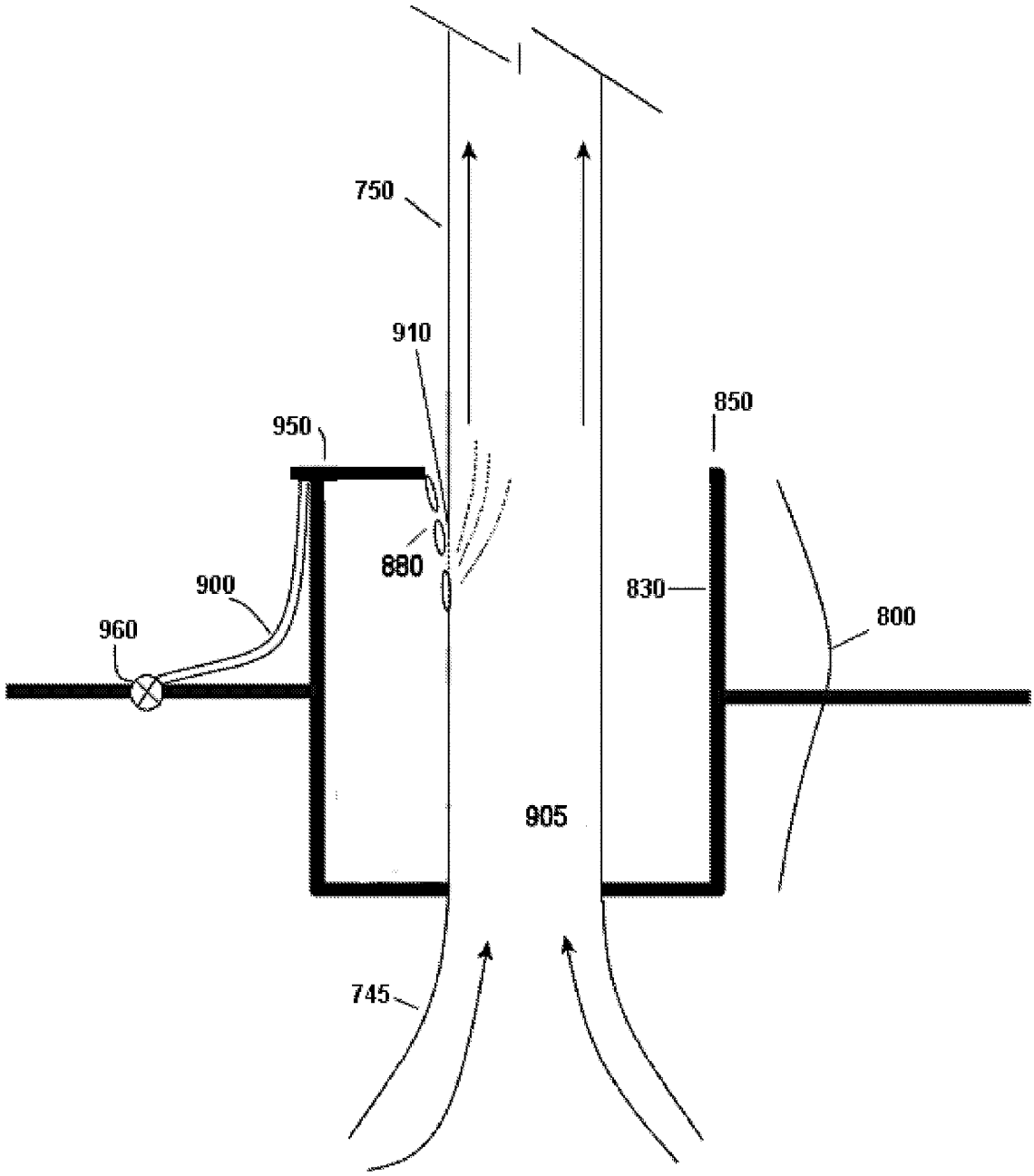
FIG. 2C shows a close up view of the exit of the laminar flow tube from the housing and the nozzle jetting the element with a drip directly impacting the laminar flow tube prior to exit.

FIG. 2C shows a close up view of the exit of the laminar flow tube from the housing and the nozzle jetting the element with an additive drip directly on the flow tube. Similar to the embodiment of FIGS. 2A and 2B, the laminar flow jet 10 utilizes an at least one jet element 115 with a nozzle 800 to produce the laminar flow jet tube 750 and the associated smooth jacket of surface tension once the laminar flow column 745 is jetted as a laminar flow tube 755 out of the nozzle 800. The nozzle has an initial point of exit 810 and a nozzle tip 850. The nozzle 800 has base portion 820 and defined walls 830 extending therefrom to the nozzle tip 850.

An additive source 950, here shown as a direct drip element, is added to the nozzle 800 such that it drips water directly onto the laminar flow tube at or near the initial point of exit 810. This is a drip element, not a stream element or scratcher, the drips do not significantly disrupt the laminarity of the tube, specifically this allows for minimum perturbation of surface tensions which are necessary to maintain a "clean" look for the exiting tube. An amount of additive 880 is allowed to drip, in this instance in small droplets, from the tip of the element on to the laminar flow tube or column 745. The amount of additive in the drip affects the resulting laminar flow jet tube 755 in different ways depending on the amount of additive 880 admitted.

At a point of entry into the column 910, the additive 880 is absorbed up by the laminar flow column 745 as it hits the laminar flow column. This is still done by a capillary action as the water and the additive meet, just in a dynamic fashion rather than a static fashion. The drip can even enhance the admission of air as the velocity difference of the drip hitting the speedier laminar flow tube creates a slightly larger hole, since the vertical velocity component of the falling drip is opposite the vertical velocity component of the exiting laminar flow tube or column. The wicking or uptake of the additive 880 creates a vacuum effect at the point of entry 910 into the column 745 drawing in air from the atmosphere and creating a minor disturbance or protuberance 905 in the jacket of the surface tension surrounding the laminar flow column being jetted. The uptake of the water is still completed so quickly that the laminar flow being jetted reaches the nozzle tip 850 and exits the nozzle tip 850 without any apparent disruption of the jacket of the surface tension surrounding the laminar flow jet tube 750 as it is formed beyond the nozzle base 820 and passes out of the tip of the nozzle 850. In the exemplary embodiment, the laminar flow jacket is closed up in at the exit of the nozzle tip 850.

The flow of the additive 880 and thereby the volume of additive available for uptake at the base portion 820 must be regulated and in this regulation the effect of the air being drawn in can be changed or completely stopped. The controller 400 can regulate the volume of additive 880 being dripped in a manner similar to the filling of the cup as identified above in FIGS. 2A and 2B above. The controller 400 can be utilized with the energetic pulse wave input to enhance these effects or can independently control this volume flow rate. Alternatively, the device can function entirely independent of the energetic pulse wave input.

The variation of flow of the additive 880 varies the take up of the additive 880 by the laminar flow 735 being passed from the nozzle base exit portion 810 and passed within the base portion 820 of the laminar jet nozzle 800 and can be adjusted by the flow of the additive into the drip hitting the laminar flow jet 745. This can be controlled through any number of mechanisms or methods adjusting the flow rate the additive drip member 950 within the nozzle 800. In the embodiment as shown, an additive line 900 with a valve 960 rests just above the base or cup 820 and drips water down onto the laminar flow tube 745 issuing forth from the initial exit portion 810. The additive 880, hitting the laminar flow tube 745, here water, is taken up by the exiting laminar flow stream 745 prior to exiting the jet nozzle 800.

The valve can be manually adjusted or can be a controlled valve in communication with the controller 400. This results in perturbations 905 in the laminar flow stream without interfering with the jacket of surface tension around the resulting laminar flow jet 750 upon exit from the nozzle tip 850. In addition to varying the flow of the additive 880 into the laminar flow 735, the flow of the additive 880 may be ceased all together to "dull" or lower the brightness of a particular portion of the laminar flow 735 as it exits the jet nozzle 800. This would in effect provide a series of bright or "on" portions of lighted laminar flow jet tube 750 and less bright or "off" portions of lighted laminar flow jet tube 750 as the tube operates, this would result in a pleasing and intricately lighted laminar flow jet tube 750, this is further exemplified in the exemplary embodiment of the method of operation shown in the Figures.

The controller 400 noted above could be located on any laminar flow device on any appropriate location. In addition to or exclusive to the control of the pulse wave generating components. The controller 400 through a control input determines the flow of additive into the base portion or cup 820. This flow can be adjusted to provide the desired perturbations 905 and provide the smooth jacket of surface tension around the jetted laminar flow tube jet 750. The controller can also provide additional volume changes in the additive 880 to adjust the effect as further described in relation to FIGS. 2A-2D and other variations or combinations to provide a variety of effects.

For example, the flow at which the additive 880 is dripped controls the resulting effect within the laminar flow column 745 and the laminar flow tube jet 755 that issues from the nozzle. If a very slow flow rate is dripped a low volume is taken up and causes a very small but persistent air space behind the point of take-up 910. This is further enhanced by the dynamic nature of the drop 882 falling into the laminar flow tube 745. This in turn creates a perturbation 905 within the laminar flow, for instance small air bubbles, and the additive drop 882 is taken up by the laminar flow tube 745 as the laminar flow tube is jetted to become the laminar flow jet 750. This perturbation 905 acts as a refractory element and increases the intensity of light shown through the resulting jetted laminar flow tube 750. This effect can be varied by the controller 400 after reading an input, such as a selection of a programmed effect selected by a user.

Figure 2D:
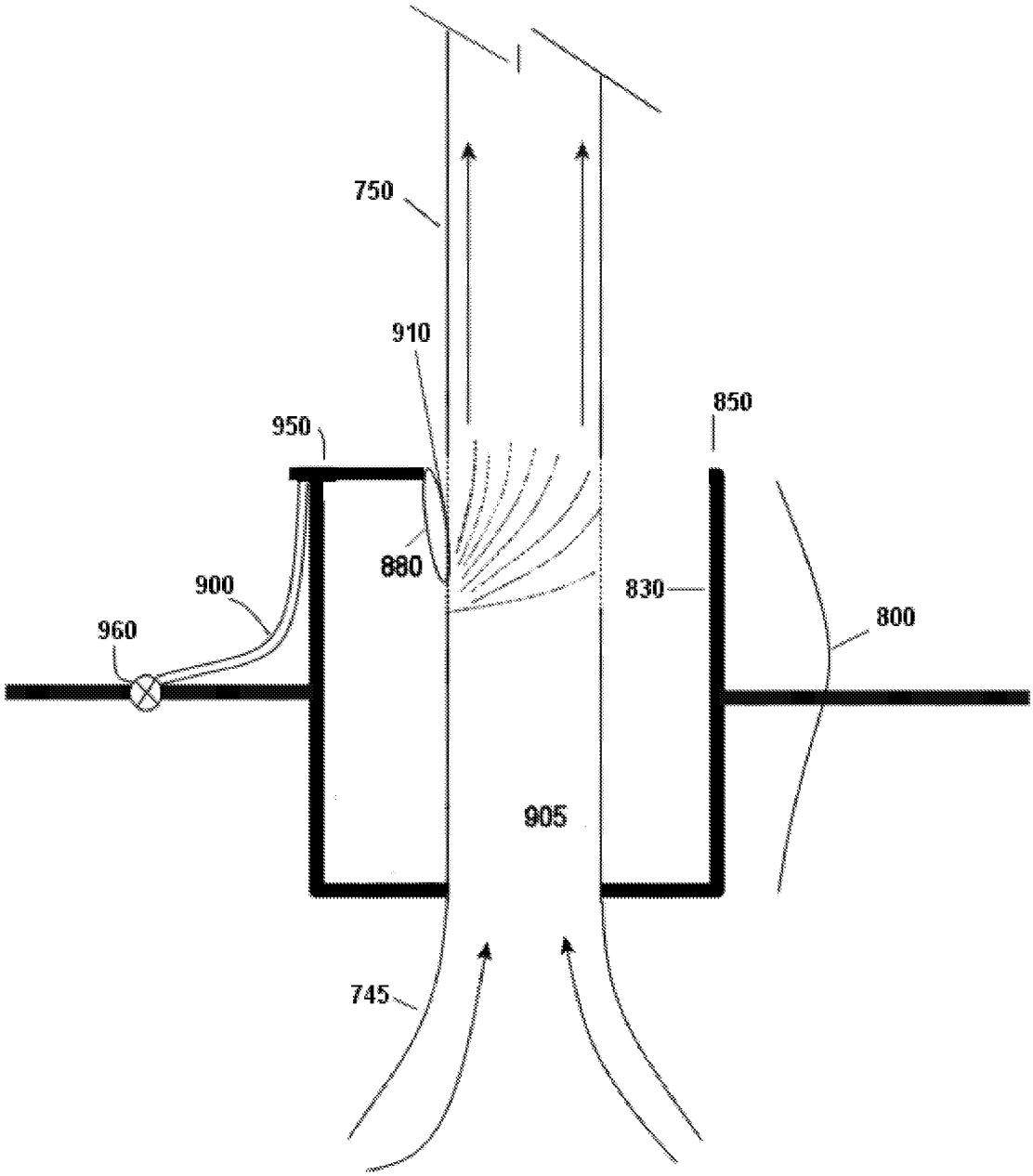
FIG. 2D shows a close up view of the exit of the laminar flow tube from the housing and the nozzle jetting the element with a larger drip directly impacting the laminar flow tube prior to exit.

FIG. 2D shows a close up view of the exit of the laminar flow tube from the housing and the nozzle jetting the element with a larger drip directly impacting the laminar flow tube prior to exit. The elements of the embodiment of FIG. 2D are substantially similar to those shown in FIG. 2C, however, the additive drip member 950 with additive 880 is shown here with a much larger droplet profile. Again, care is taken and the instant invention is distinguishable from existing "scratchers" and the like which use a protrusion to interrupt the surface tension of the laminar flow in that the additive is minimally invasive even with the larger "drip" profile. FIG. 2D shows a close up view of the exit of the laminar flow tube from the housing and the nozzle jetting the element with an additive "large" drip directly on the flow tube. Similar to the embodiment of FIGS. 2A, 2B and 2C, the laminar flow jet 10 utilizes an at least one jet element 115 with a nozzle 800 to produce the laminar flow jet tube 750 and the associated smooth jacket of surface tension once the laminar flow column 745 is jetted as a laminar flow tube 755 out of the nozzle 800. The nozzle has an initial point of exit 810 and a nozzle tip 850. The nozzle 800 has base portion 820 and defined walls 830 extending therefrom to the nozzle tip 850.

An additive source or drip member 950, here shown as a direct drip element, is added to the nozzle 800 such that it drips water directly onto the laminar flow tube at or near the initial point of exit 810. This is a drip element, not a stream element or scratcher, the drips do not significantly disrupt the laminarity of the tube, specifically this allows for minimum perturbation of surface tensions which are necessary to maintain a "clean" look for the exiting tube. An amount of additive 880 is allowed to drip, in this instance in a single larger drop, from the tip of the element on to the laminar flow tube or column 745. The amount of additive in the drip affects the resulting laminar flow jet tube 755 in different ways depending on the amount of additive 880 admitted. The single larger drop provides a more uniform perturbation across the laminar tube. The drip is large enough that it is absorbed substantially about the entirety of the laminar flow tube or column 745 as it exits the nozzle 800 and becomes the laminar flow jet tube 755.

At a point of entry into the column 910, the additive 880 is absorbed up by the laminar flow column 745 as it hits the laminar flow column. This is still done by a capillary action as the water and the additive meet, just in a dynamic fashion rather than a static fashion. The drip can even enhance the admission of air as the velocity difference of the drip hitting the speedier laminar flow tube creates an even larger hole around the substantially the entirety of the laminar flow, since the vertical velocity component of the falling drip is opposite the vertical velocity component of the exiting laminar flow tube or column. The larger drip, having a greater volume of uptake, increases this effect but still allows for "self healing" of the surface tension of the laminar flow tube 745 at or immediately following issuance from the nozzle 800. As with prior embodiments, the wicking or uptake of the additive 880 creates a vacuum effect at the point of entry 910 into the column 745 drawing in air from the atmosphere and creating a larger disturbance or protuberance 905 in the jacket of the surface tension surrounding the laminar flow column being jetted which is absorbed into the tube, in this case across the entirety of the tube due to the size of the additive drip.

The uptake of the additive, in this case water, is still completed so quickly that the laminar flow being jetted reaches the nozzle tip 850 and exits the nozzle tip 850 without any apparent disruption of the jacket of the surface tension surrounding the laminar jet tube 750 as it is formed beyond the nozzle base 820 and passes out of the tip of the nozzle 850. In the exemplary embodiment, the laminar flow jacket is closed up in at the exit of the nozzle tip 820. The controller 400 can again regulate the volume of additive 880 being dripped in a manner similar to the filling of the cup as identified above in FIGS. 2A and 2B above. The controller 400 can be utilized with the energetic pulse wave input to enhance these effects or can independently control this volume flow rate. Alternatively, the device can function entirely independent of the energetic pulse wave input or the energetic pulse wave may be operated independent of the additive flow element.

The variation of flow of the additive 880 varies the take up of the additive 880 by the laminar flow 735 being passed from the nozzle base exit portion 810 and passed within the base portion 820 of the laminar jet nozzle 800 and can be adjusted by the flow of the additive into the drip hitting the laminar flow jet tube 755. This can be controlled through any number of mechanisms or methods adjusting the flow rate the additive drip member 950 within the nozzle 800. In the embodiment as shown, an additive line 900 with a valve 960 rests just above the base or cup 820 and drips water down onto the laminar flow tube 745 issuing forth from the initial exit portion 810. The additive 880, hitting the laminar flow tube 745, here water, is taken up by the exiting laminar flow stream 745 prior to exiting the jet nozzle 800.

FIG. 3A shows an exemplary embodiment of the instant invention in operation with a segmented tubular flow. The controller 400, through the pulse or flood wave or drip perturbation 760, interrupts the laminarity of the laminar water jet tube 750, producing discrete segments of laminar flow jet tube 755 while maintaining the continuity of the tube. In addition, reflective disruptions 765 are generated throughout the segment by the update of the additive 880 from the cup 820 of the nozzle and propagated throughout the length of the jet 750 within the segments 755. The timing of the waves 760 and perturbations 905 and the length of the jet 750 and the segments 755 can thus be controlled to provide a wide number of variations in the shape and size of the laminar jets.

Additionally, the interruptions from the waves 760 in the laminar water tube issuing from the jet nozzle can result in a pleasing lighting effect, wherein each of the segments 755 provides a refractive and/or reflected concentration of light, similar to a starburst effect at an end of the segment 755, effectively a break in the transmission of the light that reflects or redirects the light out preventing it from going further. This effect results from refraction and reflection, basically a concentration of light at the point of the wave that shines the light outward through an interruption created by the wave 760 in the outer water jacket created by the water tension in forming the laminar flow water tube. This also allows for discrete multicolor segments as the point of concentration or interruption of the wave 760 acts as a boundary or interruption in the transmission of light within the tube, thereby permitting the use of different colors within each discrete segmentation 755.

Alternatively, the concentration can be reversed, that is subtle perturbations can be placed throughout a section of a given segment to effectively stop or disrupt light transmission and these perturbations can be briefly ceased, whether created by pulse or flood wave or drip perturbation. In this instance, the former perturbation 760 becomes a non-perturbed portion 760 and the segments 755 become the perturbation or perturbed portions. This would allow for a series of "on" rings or portions 760 with no perturbation that are more brightly lit and a series of duller or less lit perturbed segments 755.

FIG. 3B shows an exemplary embodiment of the instant invention in operation with a segmented columnarized flow. The tube can also be columnarized by conventional methods, such as a diverter or disrupter, or may be columnarized by a prolonged energetic pulse wave to separate the tube into discrete columns 752. The columns may then be further segmented into discrete segments 755 by the pulse or flood wave 760. The diversion or columnarization can be coordinated with color changes to provide multiple color columns 752. Similarly, the segmentation created by the interruptions from the pulse or flood waves 760 can be coordinated to provide multiple color segments 755 within the discrete columns 752. The same process for reversing the perturbation sections noted above can be utilized in the discrete colomnurization shown in FIG. 3B.

The control package 400, as previously discussed, provides a periodic, controlled protuberance or pulse within the water channel or the laminar flow. This protuberance is an energetic wave that passes through the laminar flow, through the jetting of the laminar flow, and continues as an interruption in the laminarity, producing a controlled "ripple" in the resulting laminar flow tube issuing from the jet. These periodic protuberances are produced to provide controlled interruptions, as seen in FIGS. 3A and 3B, in the laminarity of the laminar flow tube, in this instance as it exits the laminar water channel 500 at the jet element 115. This produces breaks, as shown, within the laminar out flow or laminar tube or column. In addition to the visual effect of breaking the laminar flow tube that is ejected, known as columnarization, in this case, as shown in FIG. 3B, the energetic wave can further segment different sections within the discrete columns. That is the instant invention can produce discrete pieces of laminar flow tube with or without visible gaps, as seen in FIGS. 3A and 3B. These interruptions in the laminar flow tube provide a particularly desirable effect when combined with the lighting from lighting tube 170.

The lighting tube 170 in the exemplary embodiment shown in FIG. 1 provides for illumination of the laminar flow tube as it is ejected. The illumination travels within the laminar flow tube like a fiber optic wire, reflecting within the tube and providing a pleasing colored glow. This light is interrupted by the pulse or flood wave portions 760 of the instant invention, preventing light from going beyond the interruption and preventing light in a proceeding segment from going back down the tube to the preceding section. It is also reflected and refracted in different directions by the perturbations 905 from the take up of the additive 880 from the cup or nozzle base 820 and the air trapped therein by the admission of the additive. Thus, the lighting and lighting changes within the lighting tube 170 can be coordinated with the controller 400 to provide a seemingly multicolor laminar water jet with variations in intensity and color throughout. This can be provided as a solid or columnar laminar flow water jet, as seen in FIG. 3A as described above, a single column can be provided with color variations. Besides being able to provide the typical single columnarization of the laminar flow water jet, the columnar flow water jet can be coordinated with a disruptor for segmentation within the columns to provide multi-colored column segments, as seen in FIG. 3B.

Figure 4:
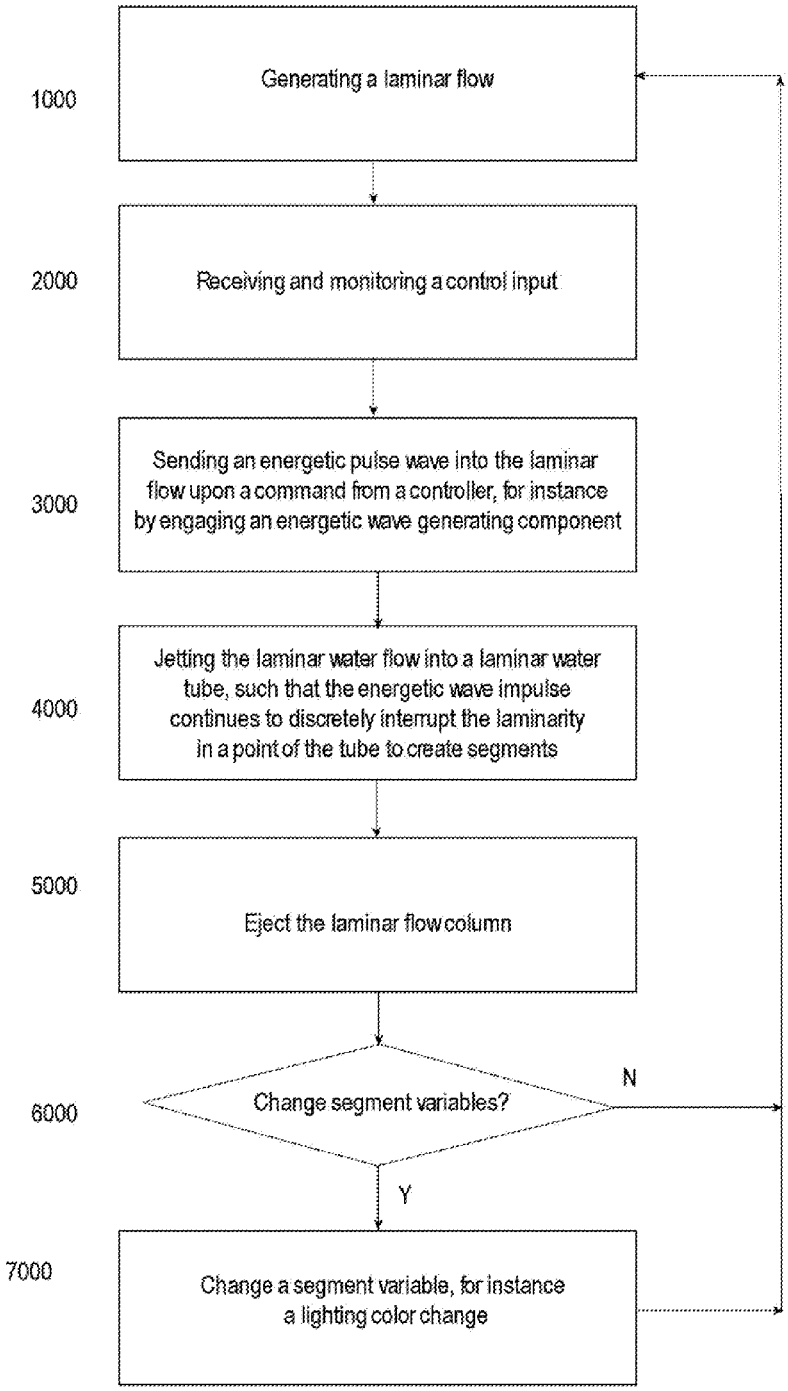
FIG. 4 shows a flow chart of an exemplary embodiment of the method of the instant invention.

FIG. 4A shows a flow chart of an exemplary embodiment of the method of the instant invention. The steps are provided in this order for this particular embodiment, the order of the steps may be varied to suit other exemplary embodiments without departing from the spirit of the invention. In the exemplary embodiment shown, the method of the instant invention is accomplished by generating a laminar flow within a water channel in conjunction with a pump in step 1000. In step 2000, a controller with a control input monitors the input. In step 2300 the controller determines if the instructions should include perturbations to enhance lighting within the tube. If such a determination is positive, in step 2500 the controller begins dripping additive into the nozzle cup or onto the laminar flow tube to provide perturbations. If a negative determination is made, no additive is started. In step 3000, an energetic pulse wave or flood wave is sent into the laminar flow upon a command from the controller, which can send the command based on a change or signal from the control input. The control input can be for instance a timer, a user selection, or other input. The controller can send the energetic pulse wave via an energetic wave generating component, for instance a solenoid, or a flood wave by increasing the flow of additive into the cup which imparts the energetic pulse wave or flood wave into the water channel to interrupt the laminarity within the water channel. It should however be noted that additional exemplary embodiments may place the input of the energetic pulse closer to the outlet of the laminar flow water jet or external to the laminar flow water jet and are within the spirit of the instant invention.

In step 4000, the laminar flow in the water channel is jetted through the cup of the jet nozzle and from the jet nozzle tip to form a laminar jet column with the interruption imparted by the energetic wave generating component or the flood wave from an additive flow component or drops from an additive component. The laminar jet column is then ejected in step 5000. Optionally, an additional step, in this instance step 6000, provides for a determination to be made regarding a segment variable. Although it may be accomplished at any time during the process, a change in a segment variable, such as a change in illumination may be conducted in coordination with a signal from the controller in step 7000. For instance, the light being shone into the column can be changed just after or just before the energetic pulse interruption. Alternatively, no change may be necessary and operations will continue from the beginning of the flow chart. The entire operation is repeated to suit the display.

Figure 5A:
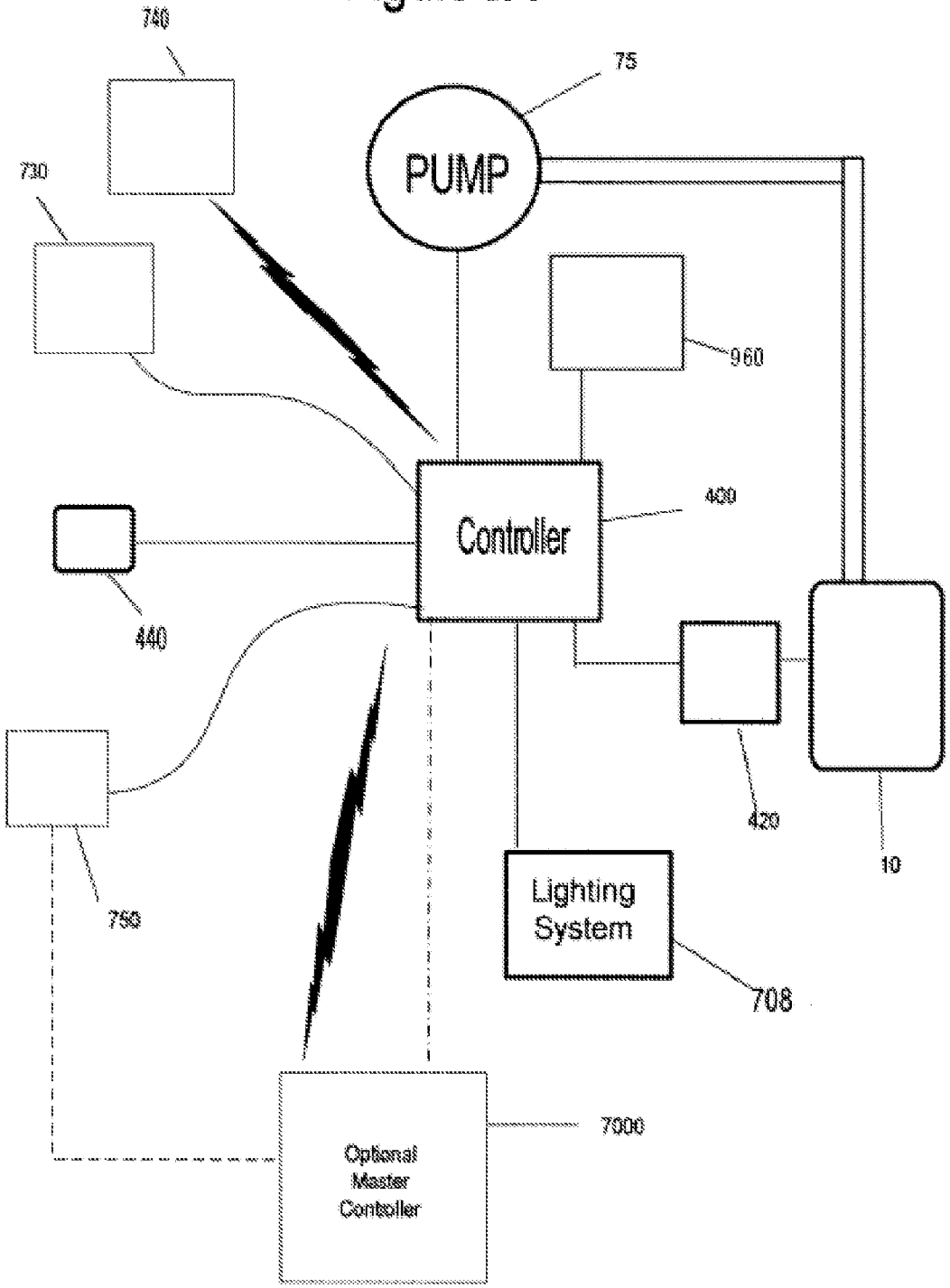
FIG. 5A shows a block schematic of the controller of a first embodiment.

FIG. 5A shows a block schematic of the controller. The block schematic diagram shows a controller 400 with an at least one control input 440, for instance input from a timer or input from an audio translator or similar control input. The controller 400 can also be in communication with pump 75. An energetic pulse wave generating component 420 is provided, which can be for instance, but is not limited to, a solenoid or any of the devices previously enumerated. The energetic pulse wave generating component 420 can generate the controlled pulse wave that creates the interruption, the "ripple", in the laminar flow within the water channel. Alternatively or in conjunction with the energetic pulse wave generating component 420, the controller 400 also controls the flow of additive 880 into the laminar flow jet nozzle 800. The energy pulse generating component 420 and/or the additive flow regulator communicates with the controller 400 to indicate its status. The controller 400 signals the energy pulse generating component 420 based on the input from the at least one control input 440. In addition to signaling the energy pulse wave generating component 420 and/or regulating the flow of the additive, the microprocessor controller 410 can additionally control lighting system(s) 700. The lighting system(s) 700 can be for instance be, but are not limited to, conventional incandescent, halogen, fiber optic, LED or similar lighting systems. Similarly, the microprocessor controller can also control an audio system 710 or other components 730, 740, 751 associated with an overall water feature presentation. These can comprise further water jets 730 or other water features, such as fountains, pop jets, waterfalls, and the like 740, 751. These additional components can be communicated with via hardwired lines or wirelessly, as shown.

In addition to controller 400, a master controller 7000 can optionally be provided, shown in shadow. The master controller 7000 can optionally (indicated by the dashed lines) communicate with the controller 400 to control the laminar flow water jet and, through controller 410 or through its own connections with the further components 730, 740, 751, additional components in a coordinated water display. This communication can be through hardwire connections or wirelessly.

Figure 5B:
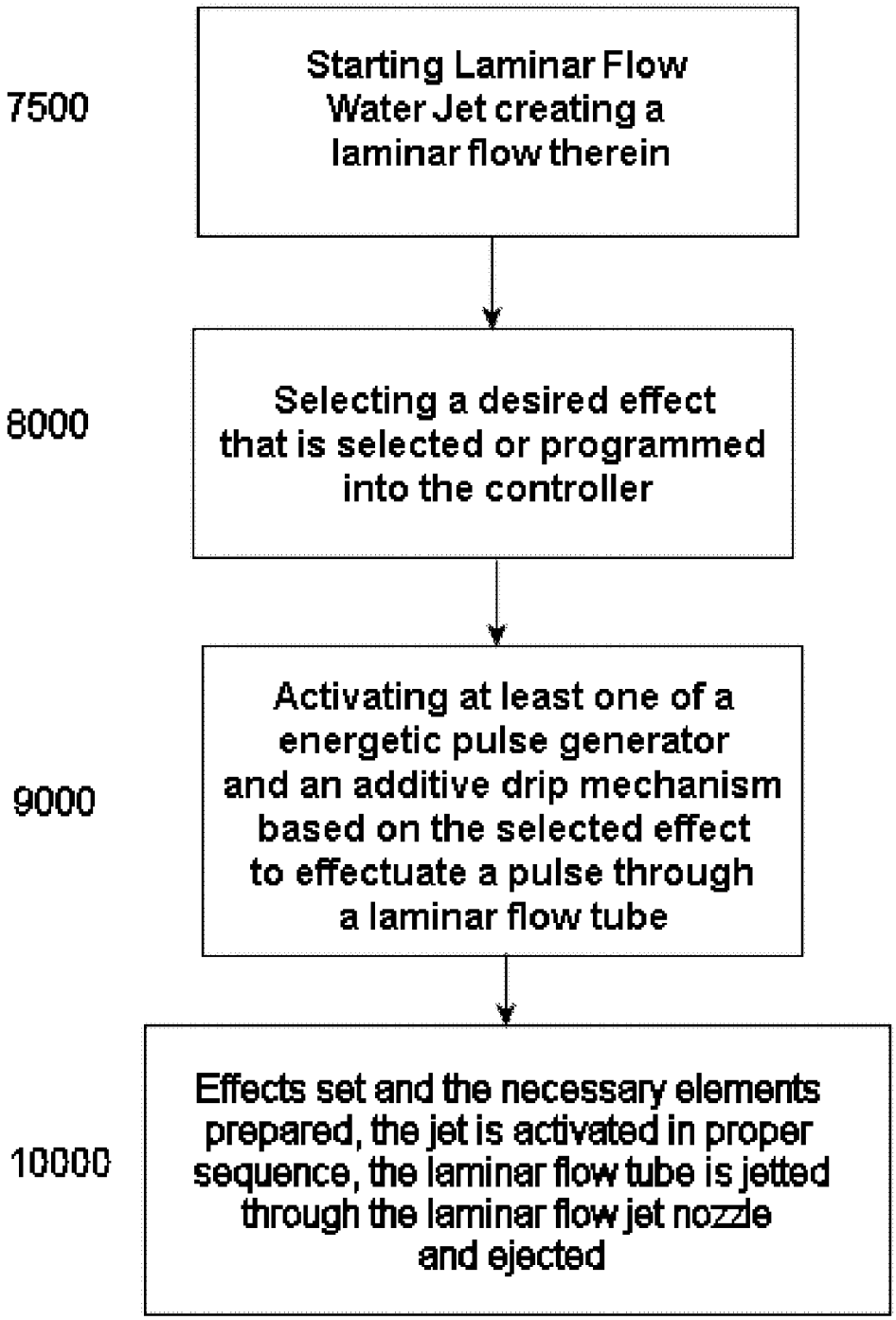
FIG. 5B shows a further flow chart of an exemplary embodiment of the method of the instant invention.

FIG. 5B shows a further flow chart of a method of controlling an exemplary embodiment of the invention. In the method of operating a laminar jet, the first step 7500 in the exemplary embodiment show is to turn the laminar flow jet on. That is, in the operation of the laminar flow jet, the controller begins the process of creating a laminar flow as disclosed above.

In method step 8000, a desired effect is selected or programmed into the controller. The desired effect can be any of the effects described above or similar effects enhancing or modifying light transmission within the laminar flow jet tube issued from the laminar flow jet. A non-limiting example, as noted in relation to FIG. 2C above, would be to apply an additive drip or flood wave to the issuing laminar flow jet tube. Alternatively or in combination, an energetic pulse wave generator may be operated to provide an energetic wave pulse, as described in relation to FIGS. 1A and 1B above to produce specific effects that may be chosen in this step.

Based on the desired effect selected in step 8000, in method step 9000 a series of conditional steps are called upon by the controller to activate the individual elements in a programmed sequence needed to achieve the desired effect. These include, but are certainly not limited to, activating at least one of an energetic pulse wave generating element and an additive drip element. If the effect requires an additive drip, either a wave into the cup in the nozzle or large or small drops may be used and the controller can activate an additive drip system as disclosed above in FIGS. 2A-2D as needed. Similarly, if an energetic pulse wave is required energizing the energetic pulse wave generator alone or together with admission of an additive flow per setting, including shutting off admission of the additive, can be undertaken. Control of segmentation and light within the column or segments is also provided based on the desired effect selected in step 8000

In method step 10000, after the desired effects are set and the necessary elements are prepared to be activated in proper sequence, the laminar flow is then jetted through the laminar flow jet nozzle. The jetting step is accomplished through, for example, programming on the controller, as indicated above in relation to FIGS. 1A-2D above. The timing of the jetting of the laminar flow jet tube is timed to produce the effect selected in method step 8000. The sequence of elements is selected and set in method step 9000. The laminar flow jet tube is issued in step 10000 with the desired effect. The desired laminar flow tube can issue, for instance, as a continuous laminar flow jet tube or as a discrete column, with variations in color in each tube or in each segment as discussed above. This can occur in conjunction with audio or video inputs or prompts or be coordinated with audio or video outputs, creating a stunning visual display.

Figure 6:
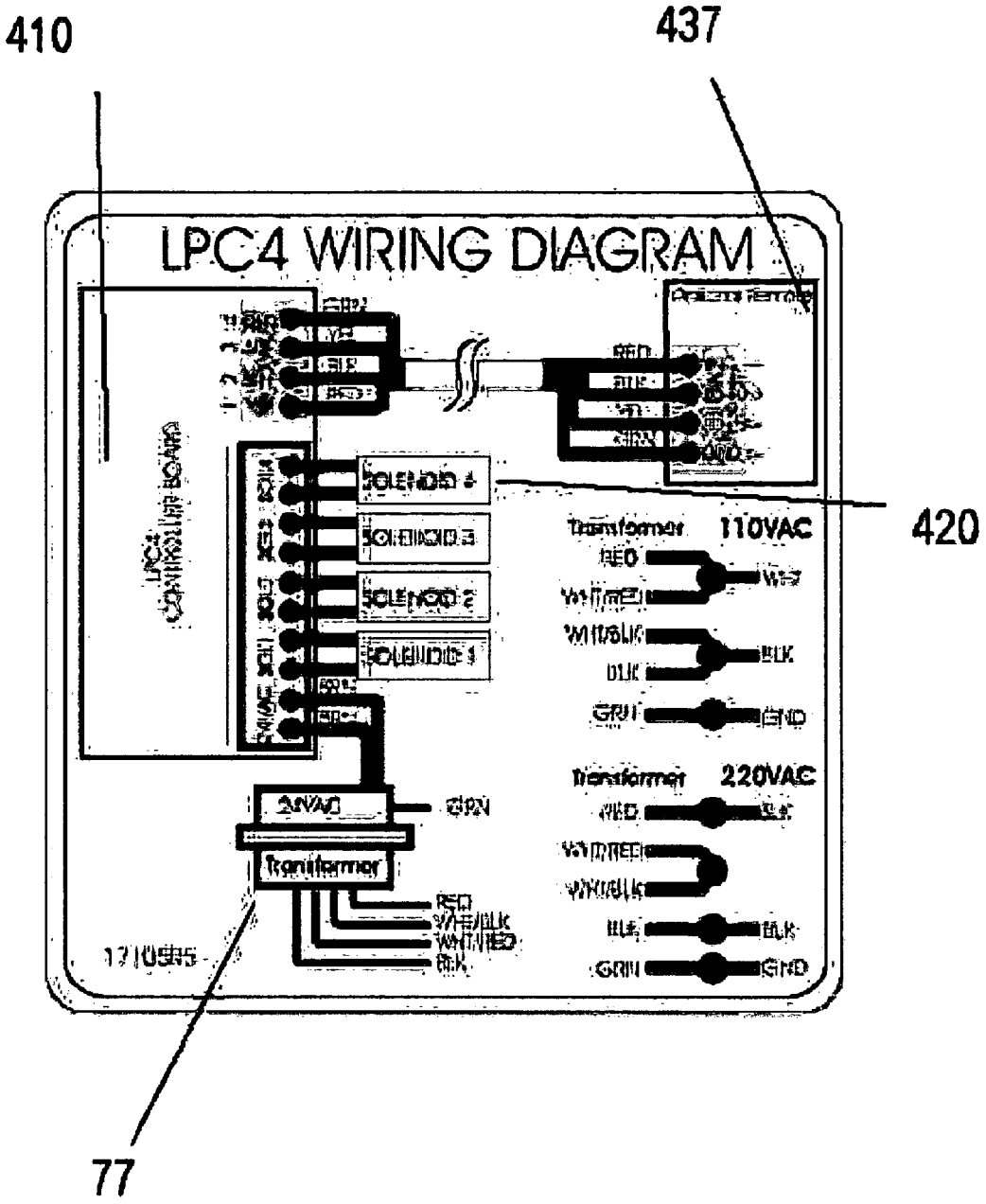
FIG. 6 shows an electrical wiring diagram of an exemplary embodiment of the controller.

FIG. 6 shows an electrical wiring diagram of an exemplary embodiment of the controller. The micro-processor 410 of controller 400 is in communication with at least one solenoid 420 and/or an additive valve 960 with an optional remote control 437 communicating with it. The power input for the system is provided through transformer 77, which provides power to the controller. The transformer 77 steps the AC current down, for instance a 110 or 240 AC power input.

The embodiments, exemplary embodiments, and examples discussed herein are non-limiting examples of the invention and its components. The invention is described in detail with respect to exemplary embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

The invention claimed is:

1. A laminar flow water jet system comprising:

an at least one water input with water flowing therein;

a housing with a water channel, the housing creating a laminar flow in the water channel from the water flowing from the at least one water input and flowing through the housing;

an at least one lighting element;

a controller;

an at least one jetting element having a cup portion and a nozzle portion and jetting a laminar flow tube from the laminar flow passing through the water channel in the housing, the laminar flow tube being ejected from the nozzle as a laminar flow jet having a smoothed tubular surface jacket and being lit by the at least one lighting element; and an at least one additive source dripping additive into the cup portion at a rate controlled by the controller, the additive being dripped into the cup portion of the jetting element at a rate to regulate the volume being absorbed by capillary action by the laminar flow tube as it is passed through the nozzle to become the laminar flow jet with a smoothed tubular surface, the capillary uptake and absorption process drawing in air from the surrounding atmosphere and creating an additive flow perturbations within the laminar flow tube, these perturbations being absorbed into the laminar flow tube and the resulting laminar flow jet without affecting the overall integrity of the smoothed tubular surface jacket of the laminar flow jet.

2. The laminar flow water jet system of claim 1, wherein the controller upon receiving a control input increases the flow of the additive to increase the volume of additive in the cup portion of the jetting element for a set period of time, the increased volume of additive substantially surrounding the entirety of the laminar flow tube, being taken up by the capillary action around the entirety of the laminar flow tube, and creating a wave perturbation throughout the laminar flow tube as the increased volume of additive surrounding the laminar flow tube is absorbed through capillary uptake along with air from the surrounding environment by the laminar flow tube and jetted out of the nozzle portion of the jetting element, the additive flow perturbations creating a variation in the laminar flow tube and the smoothed tubular surface jacket of the resulting laminar flow jet across substantially their entirety without disrupting the cohesion of the laminar flow jet.

3. The laminar flow water jet system of claim 2, further comprising an energetic pulse wave generating element, wherein the controller upon receiving a control input activates the energetic pulse wave generating element generating an energetic pulse that travels into the laminar flow tube and selectively interrupts the resulting smoothed tubular surface jacket of the laminar flow jet at a specific location on the laminar flow jet, thereby impairing the surface of and effecting the light passing within the laminar flow jet without disrupting the cohesion of the laminar flow jet.

4. The laminar flow water jet system of claim 3, wherein the energetic pulse wave or the additive flow wave perturbation provides a turbulent section within the laminar flow tube and these in turn define segments in the laminar flow jet with perturbations in the smoothed tubular surface jacket surround by the laminar flow jet without disrupting the cohesion of the laminar flow jet.

5. The laminar flow water jet system of claim 3, wherein the controller is in communication with the at least one energetic pulse wave generating element, the controller sending a command to the at least one energetic pulse wave generating element to send the energetic pulse into the laminar flow tube.

6. The laminar flow water jet system of claim 5, wherein the controller is in communication with the at least one additive source and the energetic pulse wave generating element, the controller regulating the rate at which additive is admitted so as to coordinate the admission of the additive and resulting wave perturbation with the energetic pulse perturbation.

7. The laminar flow water jet system of claim 1, further comprising an energetic pulse wave generating element generating an energetic pulse that travels into the laminar flow and selectively interrupts the laminar flow tube and the smoothness of the smoothed tubular surface jacket at a specific location in the resulting laminar flow jet.

8. The laminar flow water jet system of claim 4, wherein the controller receives a control input from at least one of a timer, a user, an audio input or a video input.

9. The laminar flow water jet system of claim 4, wherein the controller receives a control input from a master controller.

10. The laminar flow water jet system of claim 4, wherein the controller sends signals to the at least one lighting element.

11. The laminar flow water jet system of claim 10, wherein the at least one lighting element changes a color input into the laminar flow water jet tube segments based on instructions from the controller.

12. The laminar flow water jet system of claim 1, wherein the at least one lighting element further comprises an at least one lighting tube and an at least one light source.

13. The laminar flow water jet system of claim 3, further comprising a laminar flow jet disruptor in communication with the controller, wherein the laminar flow jet disruptor causes interruption of the laminar flow jet issuing from the jetting element causing discrete laminar flow jet columns to issue from the apparatus.

14. The laminar flow water jet system of claim 13, wherein the at least one lighting element communicates with the controller and lights the discrete laminar flow jet columns.

15. The laminar flow water jet system of claim 4, wherein the at least one lighting element changes a color input into the discrete segments of the laminar flow water jet.

16. The laminar flow water jet system of claim 15, wherein the discrete laminar flow jet columns are interrupted by the energetic pulse wave or additive wave perturbation such that the discrete columns are further distinctly segmented and the light source provides light to each of the distinct segments within the discrete laminar flow jet columns.

17. The laminar flow water jet system of claim 16, wherein each of the distinct segments is lit with a different color.

18. A laminar flow water jet system comprising:

an at least one water input with water flowing therein;

a housing with a water channel, the housing creating a laminar flow in the water channel from the water flowing from the at least one water input and flowing through the housing;

an at least one lighting element;

a controller;

an at least one jetting element having base and nozzle portion and jetting a laminar flow tube from the laminar flow passing through the water channel in the housing, the laminar flow tube being ejected from the nozzle as a laminar flow jet having a smoothed tubular surface jacket and being lit by the at least one lighting element; and an at least one additive source dripping additive at a rate controlled by the controller, the additive being dripped directly onto the laminar flow tube at a rate regulated such that the volume being dripped is absorbed by the laminar flow tube as it is dripped on to the laminar flow tube as it is passed through the nozzle to become the laminar flow jet, leading to an absorption process drawing in air from the surrounding atmosphere and creating additive flow perturbations within the laminar flow tube, these additive flow perturbations being absorbed into the laminar flow tube and the resulting laminar flow jet without affecting the overall integrity of the smoothed tubular surface jacket of the laminar flow jet.

19. The laminar flow water jet system of claim 18, wherein the controller upon receiving a control input increases the flow of the additive to increase the volume of additive being dripped from the jetting element, the increased volume of additive being dripped impacting around substantially the entirety of the laminar flow tube, the larger volume of additive in the drip being taken up by the laminar flow through substantially the entirety of the laminar flow tube and creating an additive flow wave perturbation through the laminar flow tube as the increased volume of additive is absorbed along with air from the surrounding environment by the laminar flow tube and jetted out of the nozzle portion of the jetting element, the additive flow wave perturbation creating a variation in the laminar flow tube and the smoothed tubular surface jacket of the resulting laminar flow jet without disrupting the cohesion of the laminar flow jet.

20. The laminar flow water jet system of claim 19, wherein the capillary uptake occurs in conjunction with impact from the velocity profile of the drop being dripped onto the laminar flow tube and the additive flow wave perturbation provides a turbulent section within the laminar flow tube and these in turn define segments in the laminar flow jet with perturbations in the smoothed tubular surface jacket surround the laminar flow jet without disrupting the cohesion of the laminar flow jet.

21. The laminar flow water jet system of claim 20, further comprising an energetic pulse wave generating element, wherein the controller upon receiving a control input activates the energetic wave generating element generating an energetic pulse or wave that travels into the laminar flow tube and selectively interrupts the resulting smoothed tubular surface jacket of the laminar flow jet as a perturbation at a specific location on the laminar flow jet, thereby impairing the surface jacket of and effecting the light passing within the laminar flow jet without disrupting the cohesion of the laminar flow jet.

22. The laminar flow water jet system of claim 19, wherein the controller is in communication with an at least one energetic pulse wave generating element, the controller sending a command to the at least one energetic pulse wave generating element to send the energetic pulse into the laminar flow tube and the additive flow wave perturbation or the energetic pulse wave, together or separately, provides a turbulent section within the laminar flow tube and these in turn define segments in the laminar flow jet with perturbations in the smoothed tubular surface jacket surround the laminar flow jet without disrupting the cohesion of the laminar flow jet.

23. The laminar flow water jet system of claim 22, wherein the controller is in communication with the at least one additive source and the energetic pulse wave generating element, the controller regulating the rate at which additive is admitted so as to coordinate the admission of the additive and resulting additive flow wave perturbation with an energetic pulse wave.

24. The laminar flow water jet system of claim 18, further comprising an energetic pulse wave generating element generating an energetic pulse that travels into the laminar flow and selectively interrupts the laminar flow tube and the smoothness of the smoothed tubular surface jacket at a specific location in the resulting laminar flow jet.

25. The laminar flow water jet system of claim 21, wherein the controller receives a control input from at least one of a timer, a user, an audio, a video input and a master controller.

26. The laminar flow water jet system of claim 21, wherein the controller sends signals to the at least one lighting element.

27. The laminar flow water jet system of claim 26, wherein the at least one lighting element changes a color input into the laminar flow water tube based on instructions from the controller.

28. The laminar flow water jet system of claim 21, the pulse wave or additive flow wave perturbation segments the laminar flow water jet into discrete segments and the at least one lighting element changes a color input into the discrete segments of the laminar flow water jet.

29. The laminar flow water jet system of claim 20, wherein the at least one lighting element further comprises an at least one lighting tube and an at least one light source.

30. The laminar flow water jet system of claim 20, further comprising a laminar flow jet disruptor in communication with the controller, wherein the laminar flow jet disruptor causes interruption of the laminar flow jet issuing from the jetting element causing discrete laminar flow jet columns to issue from the apparatus.

31. The laminar flow water jet system of claim 30, wherein the at least one lighting element communicates with the controller and lights the discrete laminar flow jet columns.

32. The laminar flow water jet system of claim 29, wherein the discrete laminar flow jet columns are interrupted by the energetic pulse wave or additive flow wave perturbation such that the discrete columns are further distinctly segmented and the light source provides light to each of the distinct segments within the laminar flow jet columns.

33. The laminar flow water jet system of claim 20, wherein the energetic pulse wave or the additive flow wave perturbation provides a turbulent section within the laminar flow tube and these in turn define segments in the laminar flow jet with perturbations in the smoothed tubular surface jacket surround the laminar flow jet without disrupting the cohesion of the laminar flow jet.

34. The laminar flow water jet system of claim 2, wherein the controller upon receiving a control input stops the flow of the additive to decrease the volume of additive in the cup portion of the jetting element for a set period of time, thereby creating a non-perturbed section, which an then be alternated with a perturbed section.

35. The laminar flow water jet system of claim 18, wherein the additive being dripped directly onto the laminar flow tube has an exit velocity and the laminar flow tube has an ejection velocity either or both of which may be controlled by the controller, the variation between these velocities being directly proportional to the amount of air being admitted into the laminar flow tube and the perturbations, which causes turbulence within the tube and thereby enhances the lighting effect within the tube, any hole in the laminar flow tube from the absorption process being healed prior to or at the ejection of the laminar flow jet and thereby ensuring the integrity of the smoothed tubular surface jacket of the laminar flow jet upon ejection.

* * * * *